US006213059B1

(12) United States Patent
Gralton et al.

(10) Patent No.: US 6,213,059 B1
(45) Date of Patent: Apr. 10, 2001

(54) TECHNIQUE FOR COOLING FURNACE WALLS IN A MULTI-COMPONENT WORKING FLUID POWER GENERATION SYSTEM

(75) Inventors: Gary Gralton, East Granby; Chang-Yu Sun, Windsor, both of CT (US); Richard E. Waryasz, Longmeadow, MA (US)

(73) Assignee: ABB Combustion Engineering Inc., Windsor, CT (US)

( * ) Notice: Subject to any disclaimer, the term of this patent is extended or adjusted under 35 U.S.C. 154(b) by 0 days.

(21) Appl. No.: 09/231,163

(22) Filed: Jan. 13, 1999

(51) Int. Cl.[7] ..... F22G 5/16

(52) U.S. Cl. ..... 122/1 B; 122/6 A; 122/406.4; 122/479.7

(58) Field of Search ..... 122/1 B, 6 A, 122/406.4, 406.5, 459, 467, 479.7

(56) References Cited

U.S. PATENT DOCUMENTS

| | | | | |
|---|---|---|---|---|
| 4,489,563 | | 12/1984 | Kalina | 60/673 |
| 4,732,005 | | 3/1988 | Kalina | 60/673 |
| 4,869,210 | * | 9/1989 | Wittchow | 122/406.5 |
| 4,982,568 | | 1/1991 | Kalina | 60/649 |
| 4,987,862 | * | 1/1991 | Wittchow et al. | 122/6 A |
| 5,029,444 | | 7/1991 | Kalina | 60/673 |
| 5,095,708 | | 3/1992 | Kalina | 60/673 |
| 5,440,882 | | 8/1995 | Kalina | 60/641.2 |
| 5,450,821 | | 9/1995 | Kalina | 122/1 |
| 5,572,871 | | 11/1996 | Kalina | 60/649 |
| 5,588,298 | | 12/1996 | Kalina et al. | 60/673 |
| 5,901,669 | * | 5/1999 | Phelps, Sr. | 122/6 A |

OTHER PUBLICATIONS

Kalina Cycles for Efficient Direct Fired Application,—Alexander I. Kalina, Yakov Lerner, Richard I. Pelletier, Exergy, Inc., Lawrence J. Peletz, Jr. ABB CE Systems, Combustion engineering, Inc.,—7 pgs.

Kalina Cycle Looks Good for Combined Cycle Generation—Dr. James C. Corman, Dr. Robert W. Bjorge, GE Power Systems, Dr. Alexander Kalina, Exergy, Inc., Jul., 1995—3 pgs.

Power Perspective, The Kalina Cycle—More Electricity From Each BTU of Fuel—1995—3 pgs.

A Gas Turbine–Aqua Ammonia Combined Power Cycle—Irby Hicks, The Thermosorb Company—Mar. 25, 1996—6 pgs.

Understanding the Kalina Cycle Fundamentals—H.A. Mlcak, P.E., ABB Lummus Crest—12 pgs.

Direct–Fired Kalina Cycle: Overview—ABB—1994—13 pgs.

Kalina Cycle System Advancements for Direct Fired Power Generation, Michael J. Davidson, Lawrence J. Peletz, ABB Combustion Engineering,—9 pgs.

Kalina Cycles and System for Direct–Fired Power Plants, A.I. Kalina, Exergy, Inc., AES—vol. 25/HTD—vol. 191—7 pgs.

* cited by examiner

*Primary Examiner*—Denise L. Ferensic
*Assistant Examiner*—Gregory A. Wilson
(74) *Attorney, Agent, or Firm*—Russell W. Warnock

(57) ABSTRACT

A technique for cooling furnace walls in a multi-component working fluid power generation system is disclosed. In a first embodiment, the technique involves removing process heat from a furnace having an inner tubular wall and an outer tubular wall. In a second embodiment, the technique involves removing process heat from a furnace system utilizing a fluid combiner. In a third embodiment, the technique involves removing process heat from a furnace having tubular walls formed of a plurality of fluid tubes.

26 Claims, 13 Drawing Sheets

TECHNIQUE FOR COOLING FURNACE WALLS IN A MULTI-COMPONENT WORKING FLUID POWER GENERATION SYSTEM

CROSS-REFERENCE TO RELATED APPLICATIONS

The present application relates to pending U.S. patent application Ser. No. 09/231,165, filed Jan. 12, 1999, for "TECHNIQUE FOR CONTROLLING REGENERATIVE SYSTEM CONDENSATION LEVEL DUE TO CHANGING CONDITIONS IN A KALINA CYCLE POWER GENERATION SYSTEM"; U.S. patent application Ser. No. 09/231,171, filed Jan. 12, 1999, for "TECHNIQUE FOR BALANCING REGENERATIVE REQUIREMENTS DUE TO PRESSURE CHANGES IN A KALINA CYCLE POWER GENERATION SYSTEM"; U.S. patent application Ser. No. 09/229,364, filed Jan. 12, 1999, for "TECHNIQUE FOR CONTROLLING SUPERHEATED VAPOR REQUIREMENTS DUE TO VARYING CONDITIONS IN A KALINA CYCLE POWER GENERATION SYSTEM"; U.S. patent application Ser. No. 09/231,166, filed Jan. 12, 1999, for "TECHNIQUE FOR MAINTAINING PROPER DRUM LIQUID LEVEL IN A KALINA CYCLE POWER GENERATION SYSTEM"; U.S. patent application Ser. No. 09/229,629, filed Jan. 12, 1999, for "TECHNIQUE FOR CONTROLLING DCSS CONDENSATE LEVELS IN A KALINA CYCLE POWER GENERATION SYSTEM"; U.S. patent application Ser. No. 09/229,630, filed Jan. 12, 1999, for "TECHNIQUE FOR MAINTAINING PROPER FLOW IN PARALLEL HEAT EXCHANGERS IN A KALINA CYCLE POWER GENERATION SYSTEM"; U.S. patent application Ser. No. 09/229,631, filed Jan. 12, 1999; U.S. patent application Ser. No. 09/231,164, filed Jan. 12, 1999, for "WASTE HEAT KALINA CYCLE POWER GENERATION SYSTEM"; U.S. patent application Ser. No. 09/229,366, filed Jan. 12, 1999, for "MATERIAL SELECTION AND CONDITIONING TO AVOID BRITTLENESS CAUSED BY NITRIDING"; U.S. patent application Ser. No. 09/231,168, filed Jan. 12, 1999, for "REFURBISHING CONVENTIONAL POWER PLANTS FOR KALINA CYCLE OPERATION"; U.S. patent application Ser. No. 09,231,170, filed Jan. 12, 1999, for "STARTUP TECHNIQUE USING MULTIMODE OPERATION IN A KALINA CYCLE POWER GENERATION SYSTEM"; U.S. patent application Ser. No. 09/229,632, filed Jan. 12, 1999, for "BLOWDOWN RECOVERY SYSTEM IN A KALINA CYCLE POWER GENERATION SYSTEM"; U.S. patent application Ser. No. 09/229,368, filed Jan. 12, 1999, for "REGENERATIVE SUBSYSTEM CONTROL IN A KALINA CYCLE POWER GENERATION SYSTEM"; U.S. patent application Ser. No. 09/229,363, filed Jan. 12, 1999, for "DISTILLATION AND CONDENSATION SUBSYSTEM (DCSS) CONTROL IN A KALINA CYCLE POWER GENERATION SYSTEM"; U.S. patent application Ser. No. 09/229,365, filed Jan. 12, 1999, for "VAPOR TEMPERATURE CONTROL IN A KALINA CYCLE POWER GENERATION SYSTEM";

U.S. patent application Ser. No. 09/229,367, filed Jan. 12, 1999, for "A HYBRID DUAL CYCLE VAPOR GENERATOR"; U.S. patent application Ser. No. 09/231,169, filed Jan. 12, 1999, for "FLUIDIZED BED FOR KALINA CYCLE POWER GENERATION SYSTEM"; U.S. patent application Ser. No. 09/231,167, filed Jan. 12, 1999, for "TECHNIQUE FOR RECOVERING WASTE HEAT USING A BINARY WORKING FLUID".

FIELD OF THE INVENTION

The present invention relates generally to the field of power generation systems, and, more particularly, to a technique for cooling furnace walls in a multi-component working fluid power generation system.

BACKGROUND OF THE INVENTION

In recent years, industrial and utility concerns with deregulation and operational costs have strengthened demands for increased power plant efficiency. The Rankine cycle power plant, which typically utilizes water as the working fluid, has been the mainstay for the utility and industrial power industry for the last 150 years. In a Rankine cycle power plant, heat energy is converted into electrical energy by heating a working fluid flowing through tubular walls, commonly referred to as waterwalls, to form a vapor, e.g., turning water into steam. Typically, the vapor will be superheated to form a high pressure vapor, e.g., superheated steam. The high pressure vapor is used to power a turbine/generator to generate electricity.

Conventional Rankine cycle power generation systems can be of various types, including direct-fired, fluidized bed and waste-heat type systems. In direct fired and fluidized bed type systems, combustion process heat is generated by burning fuel to heat the combustion air which in turn heats the working fluid circulating through the systems' waterwalls. In direct-fired Rankine cycle power generation systems the fuel, commonly pulverized-coal, gas or oil, is ignited in burners located in the waterwalls. In bubbling fluidized Rankine cycle power generation systems pulverized-coal is ignited in a bed located at the base of the boiler to generate combustion process heat. Waste-heat Rankine cycle power generation systems rely on heat generated in another process, e.g., incineration, for process heat to vaporize, and if desired superheat, the working fluid. Due to the metallurgical limitations, the highest temperature of the superheated steam does not normally exceed 1050° F. (566° C.) . However, in some "aggressive" designs, this temperature can be as high as 1100° F. (593° C.).

Over the years, efficiency gains in Rankine cycle power systems have been achieved through technological improvements which have allowed working fluid temperatures and pressures to increase and exhaust gas temperatures and pressures to decrease. An important factor in the efficiency of the heat transfer is the average temperature of the working fluid during the transfer of heat from the heat source. If the temperature of the working fluid is significantly lower than the temperature of the available heat source, the efficiency of the cycle will be significantly reduced. This effect, to some extent, explains the difficulty in achieving go further gains in efficiency in conventional, Rankine cycle-based, power plants.

In view of the above, a departure from the Rankine cycle has recently been proposed. The proposed new cycle, commonly referred to as the Kalina cycle, attempts to exploit the additional degree of freedom available when using a binary fluid, more particularly an ammonia/water mixture, as the working fluid. The Kalina cycle is described in the paper entitled: "Kalina Cycle System Advancements for Direct Fired Power Generation", co-authored by Michael J. Davidson and Lawrence J. Peletz, Jr., and published by Combustion Engineering, Inc., of Windsor, Conn. Efficiency gains are obtained in the Kalina cycle plant by reducing the energy losses during the conversion of heat energy into electrical output.

A simplified conventional direct-fired Kalina cycle power generation system is illustrated in FIG. 1 of the drawings. Kalina cycle power plants are characterized by three basic system elements, the Distillation and Condensation Subsystem (DCSS) 100, the Vapor Subsystem (VSS) 110 which includes the boiler 142, superheater 144 and recuperative heat exchanger (RHE) 140, and the turbine/generator subsystem (TGSS) 130. The DCSS 100 and RHE 140 are sometimes jointly referred to as the Regenerative Subsystem (RSS) 150. The boiler 142 is formed of tubular walls 142*a* and the superheater 144 is formed of tubular walls and/or banks of fluid tubes 144*a*. A heat source 120 provides process heat 121. A portion 123 of the process heat 121 is used to vaporize the working fluid in the boiler 142. Another portion 122 of the process heat 121 is used to superheat the vaporized working fluid in the superheater 144.

During normal operation of the Kalina cycle power system of FIG. 1, the ammonia/water working fluid is fed to the boiler 142 from the RHE 140 by liquid stream FS 5 and from the DCSS 100 by liquid stream FS 7. The working fluid is vaporized, i.e., boiled, in the tubular walls 142*a* of the boiler 142. The FS rich working fluid stream 20 from the DCSS 100 is also vaporized in the heat exchanger(s) of the RHE 140. In one implementation, the vaporized working fluid from the boiler 142 along with the vaporized working fluid FS 9 from the RHE 140, is further heated in the tubular walls/fluid tube bank 144*a*of the superheater 144. The superheated vapor from the superheater 144 is directed to and powers the TGSS 130 as FS vapor 40 so that electrical power 131 is generated to meet the load requirement. In an alternative implementation, the RHE 140 not only vaporizes but also superheats the rich stream FS 20. In such a case, the superheated vapor flow FS 9' from the RHE 140 is combined with the superheated vapor from the superheated vapor from the superheater 144 to form FS vapor flow 40 to the TGSS 130.

The expanded working fluid FS extraction 11 egresses from the TGSS 130, e.g., from an intermediate pressure (IP) or a low pressure (LP) turbine (not shown) within the TGSS 130, and is directed to the DCSS 100. This expanded working fluid is, in part, condensed in the DCSS 100. Working fluid condensed in the DCSS 100, as described above, forms feed fluid FS 7 which is fed to the boiler 142. Another key feature of the DCSS 100 is the separation of the working fluid egressing from TGSS 130 into ammonia rich and ammonia lean streams for use by the VSS 110. In this regard, the DCSS 100 separates the expanded working fluid into an ammonia rich working fluid flow FS rich 20 and an ammonia lean working fluid flow FS lean 30. Waste heat 101 from the DCSS 100 is dumped to a heat sink, such as a river or pond. The rich and lean flows FS 20, FS 30 respectively, are fed to the RHE 140. Another somewhat less expanded hot working fluid FS extraction 10 egresses from the TGSS 130, e.g., from a high pressure (HP) turbine (not shown) within the TGSS 130, and is directed to the RHE 140. Heat is transferred from the expanded working fluid FS extraction 10 and the working fluid FS lean stream 30 to the rich working fluid flow FS rich 20, to thereby vaporize the rich flow FS 20 and condense, at least in part, the expanded working fluid FS extraction 10 and FS lean working fluid flow 3Q, in the RHE 140. As discussed above, the vaporized rich flow FS 20 is fed to either the superheater 144, along with vaporized feed fluid from the boiler 142, or is combined with the superheated working fluid from the superheater 142 and fed directly to the TGSS 130. The condensed expanded working fluid from the RHE 140 forms part of the feed flow, i.e., flow FS 5, to the boiler 142, as has been previously described.

FIG. 2 details a portion of the RHE 140 of VSS 110 of FIG. 1. As shown, the RHE 140 receives ammonia-rich, cold high pressure stream FS rich 20 from DCSS 100. Stream FS rich 20 is heated by ammonia-lean hot low pressure stream FS 3010. The stream FS 3010 is formed by combining the somewhat lean hot low pressure FS extraction stream 10 from TGSS 130 with the lean hot low pressure stream FS 30 from DCSS 100, these flows being combined such that stream FS 30 dilutes stream FS 10 resulting in a desired concentration of ammonia in stream FS 3010.

Heat energy 125, is transferred from stream FS 3010 to stream FS rich 20. As discussed above, this causes the transformation of stream FS 20 into a high pressure vapor stream FS 9 or the high pressure superheated vapor stream FS 9', depending on the pressure and concentration of the rich working fluid stream FS 20. This also causes the working fluid stream FS 3010 to be condensed and therefore serve as a liquid feed flow FS 5 to the boiler 142.

As previously indicated, in one implementation the vapor stream FS 9 along with the vapor output from boiler 142 forms the vapor input to the superheater 144, and the superheater 144 superheats the vapor stream to form superheated vapor stream 40 which is used to power TGSS 130. Alternatively, the superheated vapor steam FS 9' along with the superheated vapor output from the superheater 144 forms the superheated vapor stream FS 40 to the TGSS 130.

FIG. 3 illustrates exemplary heat transfer curves for heat exchanges occurring in the RHE 140 of FIG. 2. A typical Kalina cycle heat exchange is represented by curves 520 and 530. As shown, the temperature of the liquid binary working fluid FS 20 represented by curve 520 increases as a function of the distance of travel of the working fluid through the heat exchanger of the RHE 140 in a substantially linear manner. That is, the temperature of the working fluid continues to increase even during boiling as the working fluid travels through the heat exchanger of the RHE 140 shown in FIG. 2. At the same time, the temperature of the liquid working fluid FS 3010 represented by curve 530 decreases as a function of the distance of travel of this working fluid through the heat exchanger of the RHE 140 in a substantially linear manner.

That is, as heat energy 125 is transferred from working fluid FS 3010 to the working fluid stream FS 20 as both fluid streams flow in opposed directions through the RHE 140 heat exchanger of FIG. 2, the binary working fluid FS 3010 loses heat and the binary working fluid stream FS 20 gains heat at substantially the same rate within the Kalina cycle heat exchangers of the RHE 140.

In contrast, a typical Rankine cycle heat exchange is represented by curve 510. As shown, the temperature of the water or water/steam mixture forming the working fluid represented by curve 510 increases as a function of the distance of travel of the working fluid through a heat exchanger of the type shown in FIG. 2 only after the working fluid has been fully evaporated, i.e.,, vaporized. The portion 511 of curve 510 represents the temperature of the water or water/steam mixture during boiling. As indicated, the temperature of the working fluid remains substantially constant until the boiling duty has been completed. That is, in a typical Rankine cycle, the temperature of the working fluid does not increase during boiling. Rather, as indicated by portion 512 of curve 510, it is only after full vaporization, i.e.,, full phase transformation, that the temperature of the working fluid in a typical Rankine cycle increases beyond the boiling point temperature of the working fluid, e.g., 212 degrees Fahrenheit.

As will be noted, the temperature differential between the stream represented by curve 530, which transfers the heat energy, and the Rankine cycle stream represented by curve 510, which absorbs the heat energy, continues to increase during phase transformation. The differential becomes greatest just before complete vaporization of the working fluids. In contrast, the temperature differential between the stream represented by curve 530, and the Kalina cycle stream represented by curve 520, which absorbs the heat energy, remains relatively small, and substantially constant, during phase transformation. This further highlights the enhance efficiency of Kalina cycle heat exchange in comparison to Rankine cycle heat exchange.

As indicated above, the transformation in the RHE 140 of the liquid or mixed liquid/vapor stream FS 20 to vapor or superheated vapor stream FS 9 or 9' is possible in the Kalina cycle because, the boiling point of rich cold high pressure stream FS 20 is substantially lower than that of lean hot low pressure stream FS 3010. This allows additional boiling, and in some implementations superheating, duty to be performed in the Kalina cycle RHE 140 and hence outside the boiler 142 and/or superheater 144. Hence, in the Kalina cycle, a greater portion of the process heat 121 can be used for superheating vaporized working fluid in the superheater 144, and less process heat 121 is required for boiling duty in the boiler 142. The net result is increased efficiency of the power generation system when compared to a conventional Rankine cycle type power generation system. FIG. 4 further depicts the TGSS 130 of FIG. 1. As illustrated, the TGSS 13Q in a Kalina cycle power generation system is driven by a high pressure superheated binary fluid vapor stream FS 40. Relatively lean hot low pressure stream FS extraction 10 is directed from, for instance the exhaust of an HP turbine (not shown) within the TGSS 130 to the RHE 140 as shown in FIGS. 1 and 2. A relatively lean cooler, even lower pressure flow FS extraction 11 is directed from, for instance, the exhaust of an IP or LP turbine (not shown) within the TGSS 130 to the DCSS 100 as shown in FIG. 1. As has been discussed to some extent above and will be discussed further below, both FS extraction flow 10 and FS extraction flow 11 retain enough heat to transfer energy to still cooler higher pressure streams in the DCSS 100 and RHE 140.

FIG. 5 further details the Kalina cycle power generation system of FIG. 1 for a once through, i.e.,, non-recirculating, system configuration. As shown, working fluid FS 5 and FS 7 from the RHE 140 and DCSS 100 are combined to form a feed fluid stream FS 57 which is fed to the bottom of the boiler 142. The working fluid 57 flows through the boiler tubes 142*a* where the working fluid 57 is exposed to process heat 123. The working fluid is heated and vaporized in the boiler tubes 142*a*, while cooling the boiler walls. Sufficient liquid working fluid must be supplied by feed stream FS 57 to provide an adequate flow to the boiler tubes 142*a* to ensure proper cooling during system operation. Without an adequate flow to the boiler tubes 142*a*, the boiler tubes 142*a* can become overheated causing a premature failure of the boiler tubes 142*a*, particularly in the combustion chamber, and requiring system shut-down for repair. The heated working fluid rises in the boiler tubes 142*a* and the fully vaporized working fluid stream is directed from the boiler tubes 142*a* as stream FS 8 and combined with the vapor stream FS 9 from the RHE 140. The combined vaporized fluid stream FS 89 is directed to the superheater 144, where it is exposed to process heat 122. The high pressure superheated vapor flow FS 40 is directed from the superheater 144.

The TGSS 130, as shown, includes both a HP turbine 130' and an IP turbine 130". The superheated high pressure vapor stream FS 40 is directed first to the HP turbine 130' of the TGSS 130 and then to the IP turbine 130" of the TGSS 130. The vapor flow FS 40 must be sufficient to provide the necessary energy to drive the turbines so that the required power is generated. The lower pressure hot working fluid exhausted from the HP turbine 130' is split into a lower pressure vapor working fluid stream FS 40' to the boiler 142 where it is reheated and then sent to the IP turbine 130" and an extraction flow FS 40" to the RHE 140. Typically, approximately 50% of the exhaust flow from the HP turbine 130' is split off as stream FS 40" to the RHE 140, although this may vary. The even lower pressure hot working fluid exhausted from the IP turbine 130" is split into a working fluid stream FS 11 which is fed to the DCSS 100 and extraction flow FS 40'" which is fed to the RHE 140. It will be understood that the TGSS 130 could also include other turbines, e.g., a LP turbine to which a portion of the fluid flow from the IP turbine might be first directed before being directed from the TGSS 130 to the DCSS 100. The lean hot working fluid extraction streams FS 40" and FS 40'"from the TGSS 130 are combined to form stream FS 10, which is further combined, as previously discussed, with lean hot working fluid stream FS 30 from the DCSS 100 to form a hot working fluid stream 3010. Stream 3010 is directed on to the RHE 140.

The RHE 140, as previously described receives the hot stream FS 3010 and a rich cold fluid stream FS 20 from the DCSS 100. Heat is transferred from the stream FS 3010 to vaporize stream FS 20. During this process, the steam FS 3010 is condensed to form condensate 3010' which is fed to the boiler 142 as liquid stream FS 5.

FIG. 6 illustrates a furnace structure 146 incorporating both the boiler 142 and the superheater 144. As shown, the furnace structure 146 has a primary (lower) section 146', a secondary (upper) section 146", and a backpass section 146'". The boiler 142 is located in the lower section 146' and the superheater 144 is located in the upper section 146". The heat source 120, which in this instance is shown to be a pair of direct-fired burners 124 located in the walls of the boiler 142 but, as previously described, may also be waste heat or a fluidized bed, generates process heat within the furnace structure 146. The backpass section 146'", which generally directs combustion and flue gases 147 to an exhaust stack (not shown), can also be used to support further heat exchange devices, which are typically operating at temperatures that are lower than the operating temperatures in either the boiler 142 or the superheater 144 due to the relatively lower temperature of the combustion and flue gases 147 passing through the backpass section 146'".

As previously described, the boiler 142 is formed of tubular walls 142*a*, and the superheater 144 is formed of tubular walls and/or banks of fluid tubes 144*a*. The tubular walls 142*a* typically include a plurality of wall fluid tubes 142*a*', and the tubular walls and/or banks of fluid tubes 144*a*typically include a plurality of wall fluid tubes 144*a*' and/or suspended fluid tubes 144*a*" , respectively, as shown. The wall fluid tubes 142*a*', the wall fluid tubes 144*a*', and the suspended fluid tubes 144*a*" are typically interconnected through headers (not shown) in the furnace structure 146.

As also previously described, working fluid passes through the tubular walls 142*a* of the boiler 142 and the tubular walls and/or banks of fluid tubes 144*a*of the superheater 144 so as to generate superheated vapor for powering the TGSS 130 and generating electrical power. However, the working fluid passing through the tubular walls 142*a* of the boiler 142 and the tubular walls and/or banks of fluid tubes 144*a*of the superheater 144 also works to cool the walls of the furnace structure 146, particularly in the boiler 142, or wherever else the heat source 120 might be located. That is, the working fluid works to protect the walls of the furnace structure 146 from the high temperatures generated by the heat source 120 and thereby prevent material and/or structural damage to the furnace structure 146.

During normal operation, the walls of the furnace structure 146 are generally protected from overheating by flows of the liquid working fluid stream FS 5 from the RHE 140, the liquid working fluid stream FS 7 from the DCSS 100, and, to a lesser degree, the vaporized working fluid stream FS 9 from the RHE 140. However, during start-up and/or low-load operation there is typically insufficient vapor flow through the tubular walls 142*a* of the boiler 142 and the tubular walls and/or banks of fluid tubes 144*a* of the superheater 144 to cool the walls of the furnace structure 146. Thus, the walls of the furnace structure 146, particularly in the boiler 142, or wherever else the heat source 120 might be located, are susceptible to being overheated and damaged during start-up and/or low-load operation.

Further, even during normal operation the flow rate through the tubular walls 142*a* of the boiler 142 and the tubular walls and/or banks of fluid tubes 144*a*of the superheater 144 may be insufficient to cool the walls of the furnace structure 146. That is, despite the fact that some working fluid may be flowing through the tubular walls 142*a* of the boiler 142 and the tubular walls and/or banks of fluid tubes 144*a* of the superheater 144, the flow rate of such working fluid may be insufficient to cool the walls of the furnace structure 146. For example, this may occur when the heat source 120 is generating very high process heat, and/or when the entire furnace structure 146 is operating as a superheater. Thus, the walls of the furnace structure 146, particularly in the boiler 142, or wherever else the heat source 120 might be located, are susceptible to being overheated and damaged even during normal operation.

One proposal to overcome an overheating problem in a furnace is described in U.S. Pat. No. 5,588,298 ('298 patent), issued to Kalina et al. on Dec. 31, 1996, and hereby incorporated herein by reference. In the '298 patent, Kalina et al. describe a furnace system having two independent combustion zones and two corresponding independent heat exchanger systems in a single furnace system. The two independent heat exchanger systems support two totally separate working fluid streams, which may or may not be combined in an external power system.

One supposed benefit of the furnace system described in the '298 patent is that the temperature in each combustion zone can be independently controlled, thereby preventing excessive tube metal temperatures and subsequent damage to the walls of the furnace. However, there are also several disadvantages associated with the furnace system described in the '298 patent. One such disadvantage is that there are two totally separate combustion systems, as well as two totally separate heat exchanger systems and working fluid streams, to maintain. Another disadvantage is that two separate control systems are required to control and coordinate the two totally separate combustion and heat exchanger systems. A further disadvantage is that temperature differences between the two totally separate combustion zones and corresponding independent heat exchanger systems can result in material expansion differences which can cause joint failures in the walls of the furnace system. The above-stated disadvantages are prevalent in any furnace system employing two or more combustion zones and/or two or more heat exchanger systems in a single furnace.

In view of the above, it is readily apparent that a satisfactory solution to the problem of furnace wall overheating in a Kalina cycle power generation system has yet to be discovered. Accordingly, it would be desirable to overcome the above-described problems and disadvantages and provide a technique for cooling furnace walls in a Kalina cycle power generation system.

OBJECTS OF THE INVENTION

Accordingly, it is an object of the present invention to provide a technique for cooling furnace walls in a multi-component working fluid power generation system.

It is another object of the present invention to provide a technique for removing process heat from a furnace having an inner tubular wall and an outer tubular wall.

It is another object of the present invention to provide a technique for removing process heat from a furnace system utilizing a fluid combiner.

It is another object of the present invention to provide a technique for removing process heat from a furnace having tubular walls formed of a plurality of fluid tubes.

Additional objects, advantages, novel features of the present invention will become apparent to those skilled in the art from this disclosure, including the following detailed description, as well as by practice of the invention. While the invention is described below with reference to a preferred embodiment(s), it should be understood that the invention is not limited thereto. Those of ordinary skill in the art having access to the teachings herein will recognize additional implementations, modifications, and embodiments, as well as other fields of use, which are within the scope of the invention as disclosed and claimed herein and with respect to which the invention could be of significant utility.

SUMMARY OF THE INVENTION

According to the present invention, a technique for cooling furnace walls in a multi-component working fluid power generation system is provided. In a first embodiment, the technique involves removing process heat from a furnace, wherein the process heat is provided within a heat zone such as, for example, a combustion zone, within the furnace. Typically, a fuel such as, for example, oil, gas or coal, is combusted so as to generate the process heat within the heat zone. In any event, the technique can be realized by providing a first multi-component working fluid such as, for example, a binary working fluid containing ammonia and water, to a first tubular wall of the furnace so as to absorb a first portion of the process heat. A second multi-component working fluid is provided to a second tubular wall of the furnace so as to absorb a second portion of the process heat. Preferably, the first tubular wall is located closer to the heat zone than the second tubular wall so as to shield some of the process heat from the second tubular wall.

In one aspect of the present invention, the first multi-component working fluid has a higher boiling point than the second multi-component working fluid. Consequently, the first multi-component working fluid, which is preferably provided in liquid form, is typically vaporized by the first portion of the process heat, while the second multi-component working fluid, which is preferably provided in vapor form, is typically superheated by the second portion of the process heat. Since the first multi-component working fluid is preferably provided in liquid form, a pump may be used to provide the first multi-component working fluid to the first tubular wall.

In another aspect of the present invention, the first multi-component working fluid transfers at least some of its absorbed process heat to the second multi-component working fluid. This transfer is preferably performed in a recuperative heat exchanger.

In a second embodiment, the technique involves removing process heat from a furnace system. Again, the process heat may be generated by combusting a fuel such as, for example, oil, gas or coal. However, the process heat may also be provided from waste heat or other heat sources. In any event, the technique can be realized by providing a first working fluid such as, for example, a binary working fluid containing ammonia and water, to a first set of fluid channels so as to absorb a first portion of the process heat. The first set of fluid channels are typically fluid tubes forming a first tubular wall of the furnace system. Preferably, the first fluid channels form a tubular wall of the furnace system.

The heated first working fluid from the first set of fluid channels is combined. That is, the heated first working fluid flowing from all of the first fluid channels is combined to form a single stream of heated first working fluid. This single stream of heated first working fluid is then combined with a second working fluid such as, for example, a binary working fluid containing ammonia and water. The combination of the heated first working fluid and the second working fluid are provided to a second set of fluid channels so as to absorb a second portion of the process heat. The second set of fluid channels are typically fluid tubes forming a second tubular wall of the furnace system. Preferably, the second fluid channels form an upper tubular wall of the furnace system.

The first portion of the process heat typically superheats the first working fluid, which is preferably provided in vapor form. Similarly, the second portion of the process heat typically superheats the combination of the heated first working fluid and the second working fluid, which is also preferably provided in vapor form. Further, the first working fluid preferably has a higher boiling point than the second working fluid.

In one aspect of the present invention, the first working fluid is beneficially preheated so as to vaporize the first working fluid before it is provided to the first set of fluid channels. On the other hand, the second working fluid is beneficially preheated so as to superheat the second working fluid before it is combined with the first working fluid.

In a third embodiment, the technique involves removing process heat from a furnace having tubular walls formed of a plurality of fluid tubes. Again, the process heat may be generated by combusting a fuel such as, for example, oil, gas or coal. The process heat may also be provided from waste heat or other heat sources. However, the technique is particularly beneficial when the process heat is provided directly to at least a portion of the plurality of fluid tubes. In any event, the technique can be realized by providing process heat within the furnace, and then providing a vaporized multi-component working fluid such as, for example, a binary working fluid containing ammonia and water, to the plurality of fluid tubes so as to absorb at least a portion of the process heat.

Due to the high temperatures of the process heat, and due to the fact that the vaporized multi-component working fluid is also in a heated form, at least some, if not all, of the plurality of fluid tubes should be fabricated of a high temperature tolerant metal such as, for example, INCONEL 800 or an equivalent. Also, the plurality of fluid tubes can be coated so as to prevent heat degradation such as, for example, fire-side corrosion, of the fluid tubes.

BRIEF DESCRIPTION OF THE DRAWINGS

In order to facilitate a fuller understanding of the present invention, reference is now made to the appended drawings. These drawings should not be construed as limiting the present invention, but are intended to be exemplary only.

DETAILED DESCRIPTION OF THE INVENTION

Figure 1:
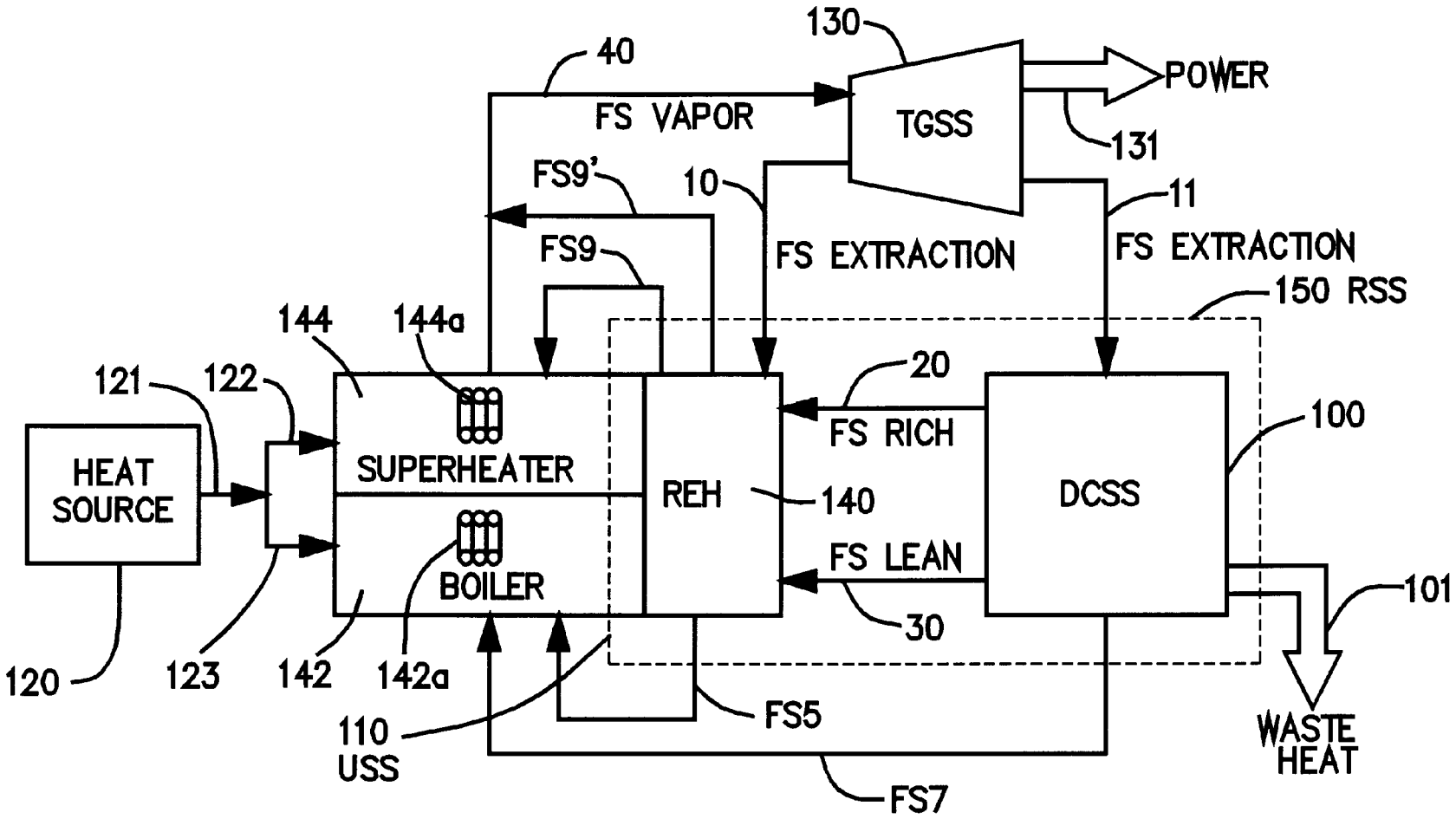
Figure 1 (PRIOR ART)
FIG. 1 depicts a simplified block diagram of a conventional Kalina cycle power generation system.
Figure 2:
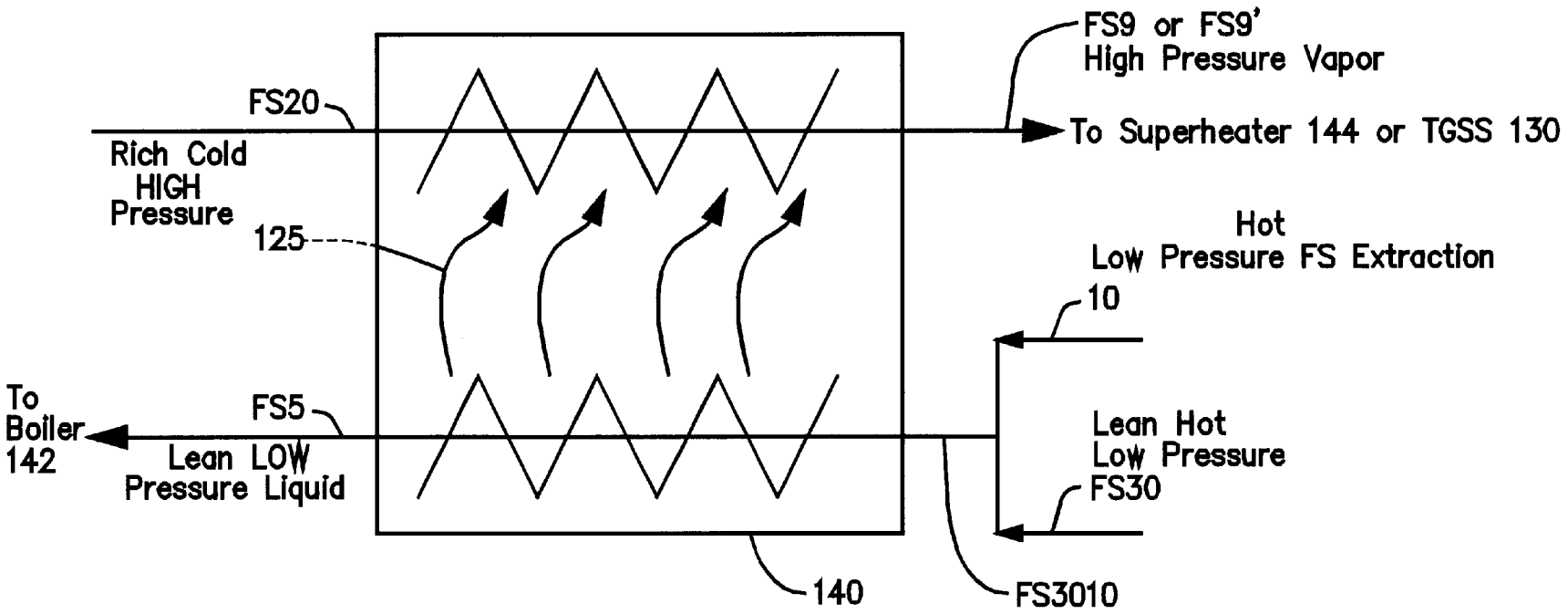
Figure 2 (PRIOR ART)
FIG. 2 partially details the RHE of the conventional Kalina cycle power generation system of FIG. 1.
Figure 3:
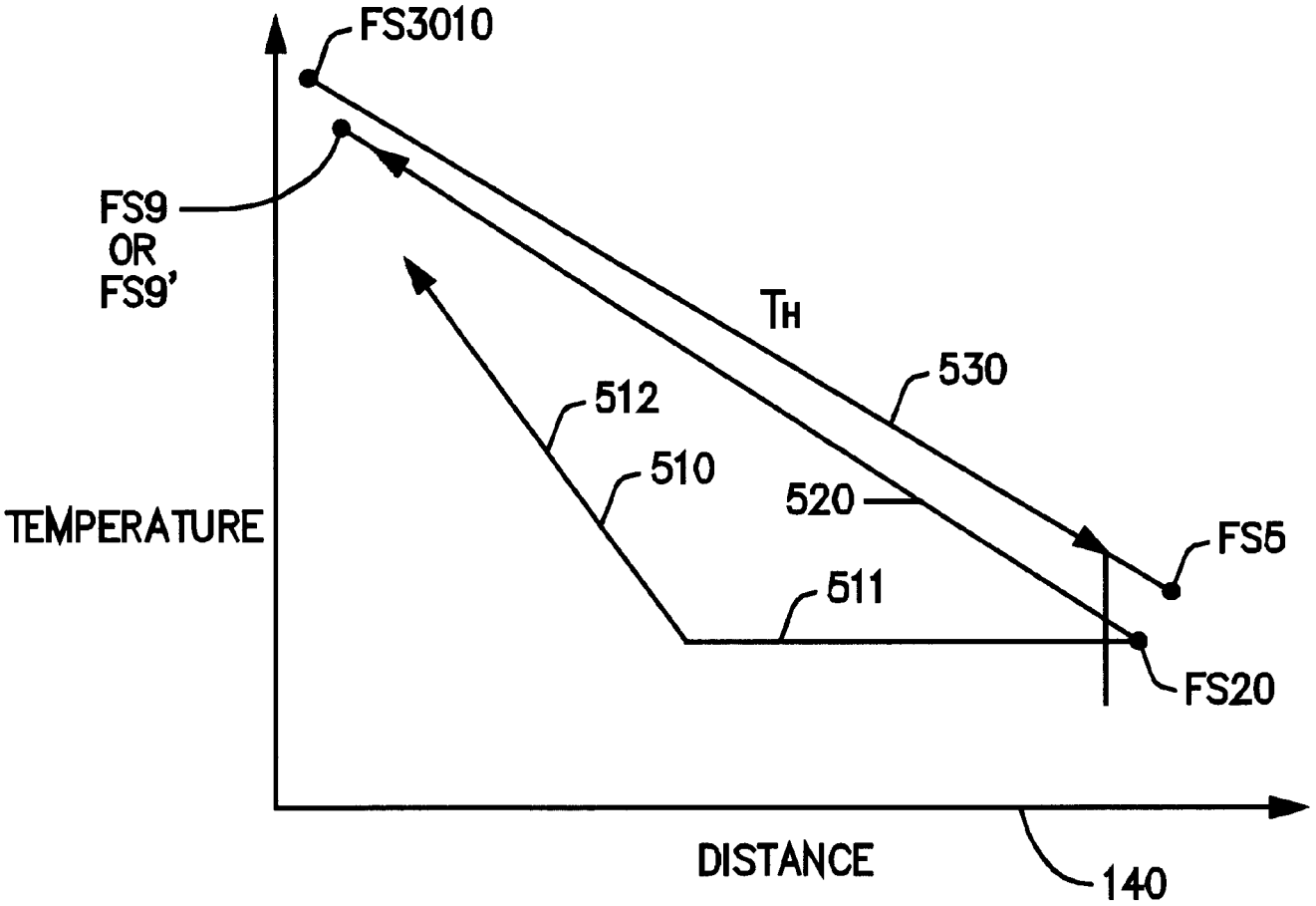
Figure 3 (PRIOR ART)
FIG. 3 illustrates the basic heat exchange between flow streams in the RHE detailed in FIG. 2.
Figure 4:
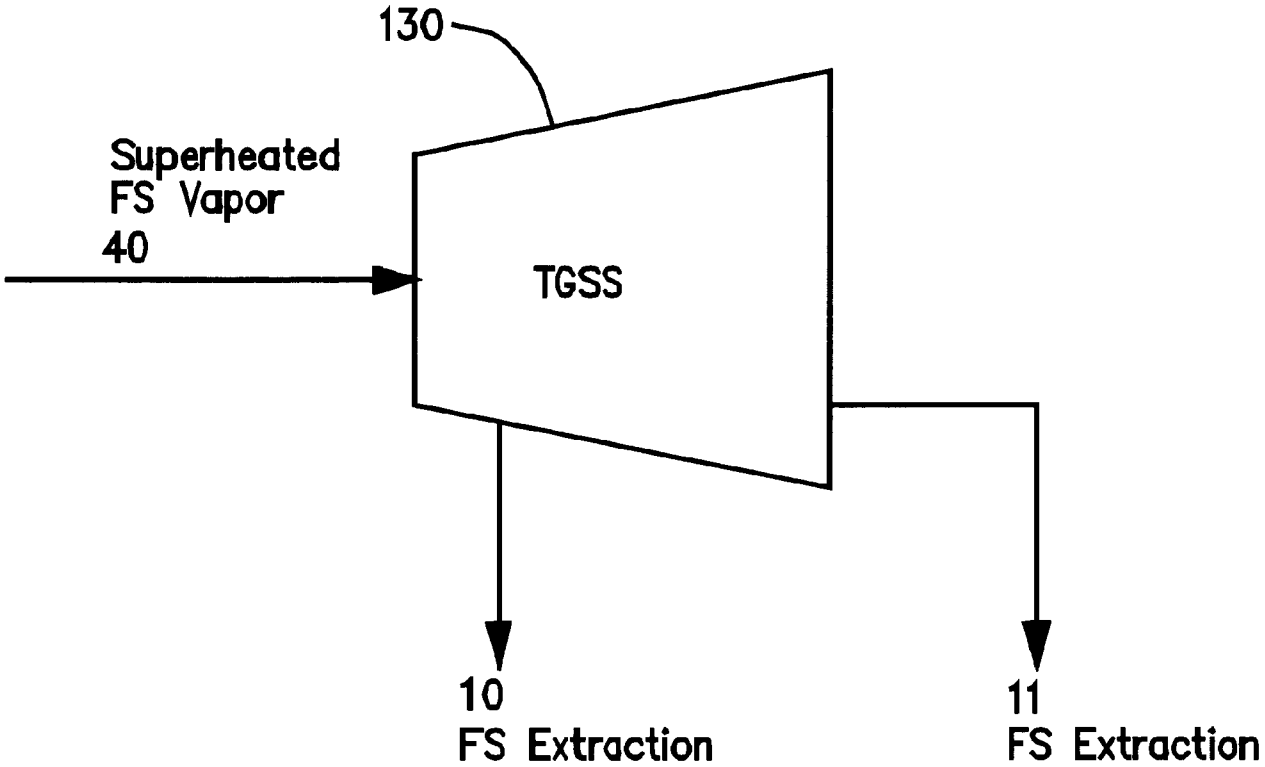
Figure 4 (PRIOR ART)
FIG. 4 partially details the TGSS of the conventional Kalina cycle power generation system of FIG. 1.
Figure 5:
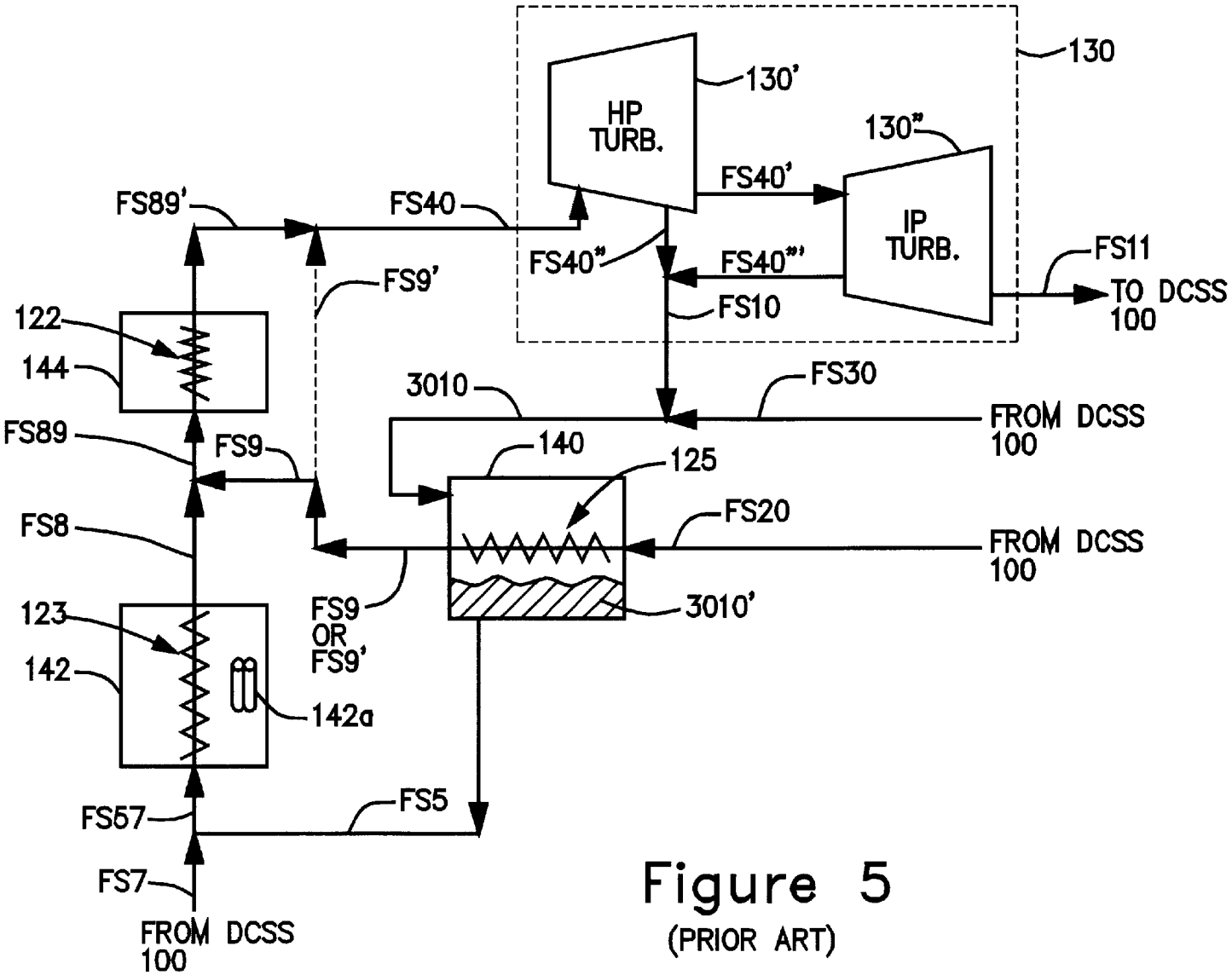
Figure 5 (PRIOR ART)
FIG. 5 is a more detailed representation of the conventional Kalina cycle power generation system of FIG. 1 depicting a once-through flow configuration.
Figure 6:
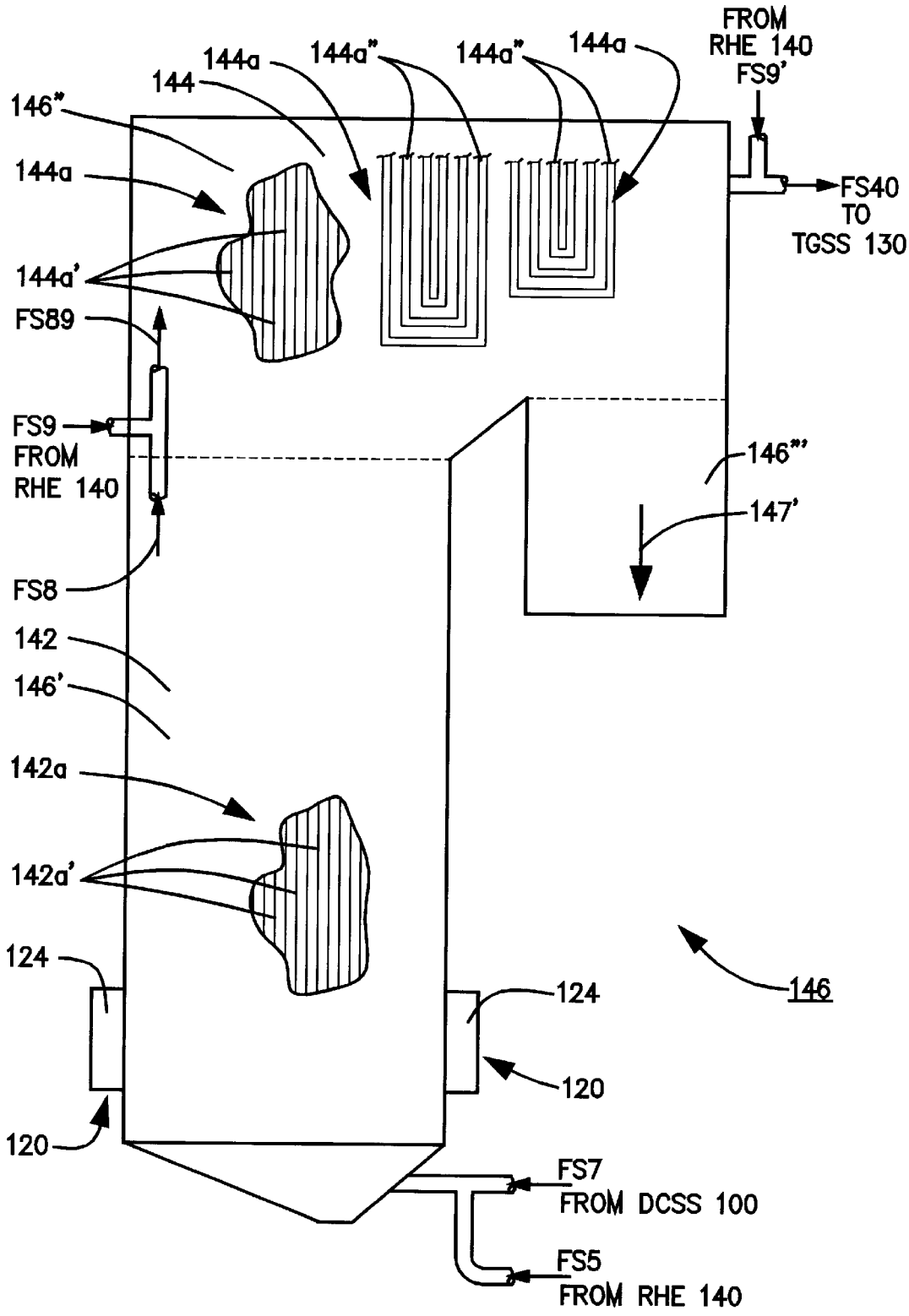
Figure 6 (PRIOR ART)
FIG. 6 illustrates a furnace structure incorporating the boiler and the superheater of the conventional Kalina cycle power generation system of FIG. 1.
Figure 7:
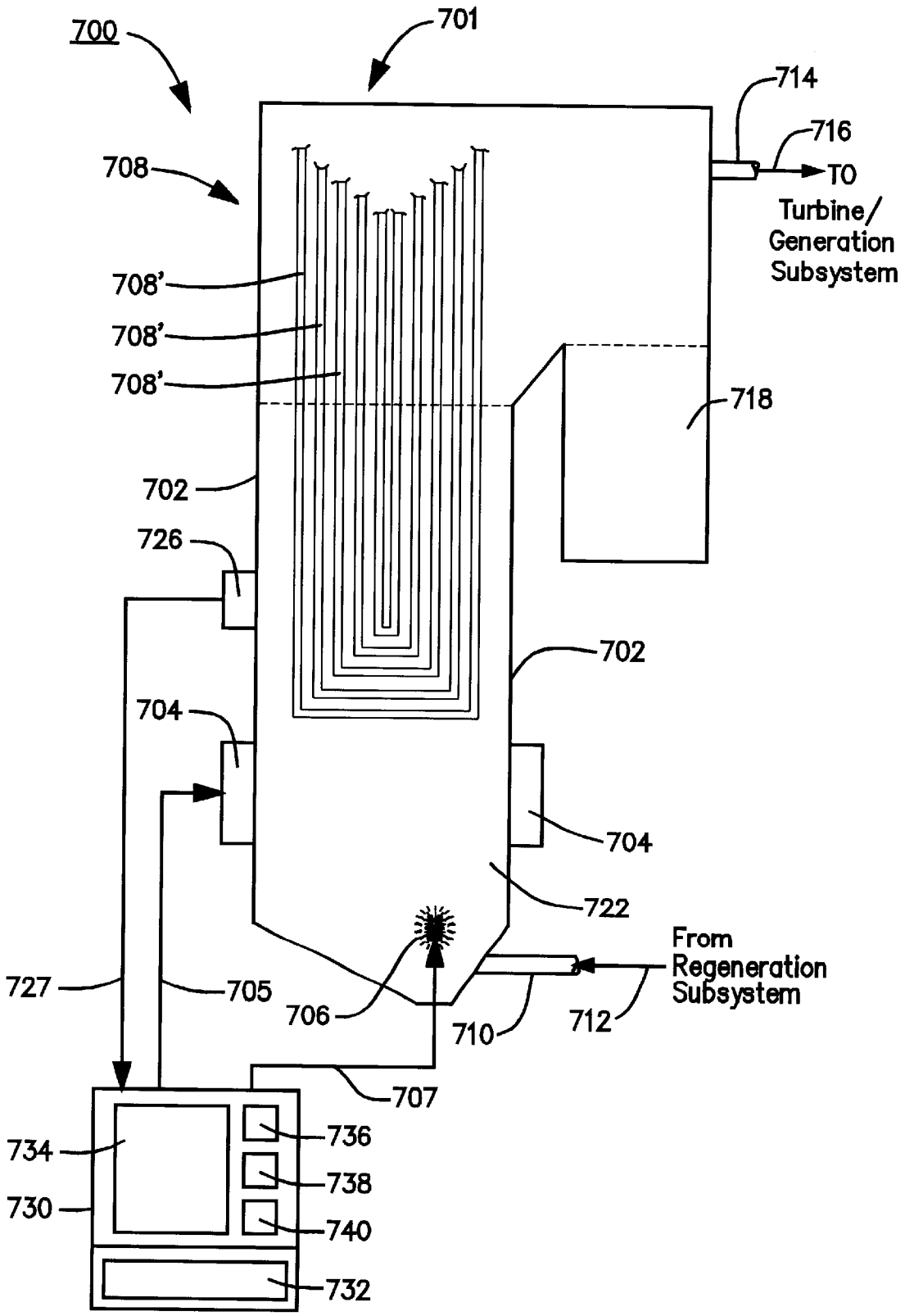
FIG. 7 illustrates a furnace system having a liquid fossil fuel-fired burner and a solid fossil fuel-fired burner in a primary section of a furnace structure in accordance with the present invention.

FIG. 7 illustrates a furnace system 700 for use in a multi-component working fluid power generation system in accordance with the present invention. The furnace system 700 includes a furnace structure 701 comprising tubular walls 702 and a single bank of coal-fired burners 704, which are located in the tubular walls 702. The furnace structure 701 also comprises a liquid fossil fuel-fired burner 706 and one or more hanging superheat panels 708 formed of suspended fluid tubes 708'. The furnace structure 701 further comprises a vapor flow sensor 726 for sensing the vapor flow through the tubular walls 702 of the furnace structure 701. The furnace structure 701 still further comprises one or more fluid entry tubes 710 for conveying a liquid binary working fluid 712 to the furnace structure 701, and one or more fluid exit tubes 714 for conveying a superheated binary working fluid 716 from the furnace structure 701. The liquid binary working fluid 712 typically flows to the furnace structure 701 from a regeneration subsystem (not shown) of a multi-component working fluid power generation system, and the superheated binary working fluid 716 typically flows from the furnace structure 701 to a turbine/generator subsystem (not shown) of a multi-component working fluid power generation system.

The furnace system 700 also includes a controller 730, which includes a keyboard 732 for receiving information from a user and a monitor 734 for displaying information to a user. It should be understood that other types of input devices, e.g., a keypad, mouse, touch screen or other devices, and other types of output devices, e.g., a printer, voice synthesizer or other devices, could be substituted if desired for the keyboard 732 and monitor 734, respectively. The controller 730 also includes logic 736, which will typically be in the form of hardware logic devices or software logic stored on a medium, and a processor 738 for processing, in accordance with the logic 736, information provided as an input by a user via the keyboard 732. The processor 738, in accordance with the logic 736, also processes control signals received from the vapor flow sensor 726 via communications line 727, and generates and directs the transmission of control signals to the solid fossil fuel-fired burners 704 via communications line 705 so as to control the operation of the liquid fossil fuel-fired burners 704, and to the liquid fossil fuel-fired burner 706 via communications line 707 so as to control the operation of the liquid fossil fuel-fired burner 706, as described in detail below. The logic 736 may include an algorithm or an access instruction to a look-up table having a burner index with preselected burner set points or other data stored in a memory 740 of the controller 730 which can be used to determine the appropriate level of operation for the burners 704, 706 based upon received vapor flow information from vapor flow sensor 726.

During start-up operation, the liquid fossil fuel-fired burner 706 is brought on-line so as to perform evaporative duty on the liquid binary working fluid 712 as the liquid binary working fluid 712 flows into the furnace structure 701 from the regeneration subsystem through the fluid entry tubes 710. The liquid fossil fuel-fired burner 706 is used to provide this initial evaporative duty for several reasons. First, the liquid fossil fuel-fired burner 706 can typically be brought on-line much quicker than most solid fossil fuel-fired burners, thereby decreasing the time required for start-up operation. Secondly, the liquid fossil fuel fired burner 706 can typically be operated so as to control the temperature of the process heat within the furnace structure 701 in a manner that is much more accurate than most solid fossil fuel fired burners. This prevents large temperature differences from occurring between the combustion gases and the binary working fluid, which can lead to substantial heat losses. Thirdly, the liquid fossil fuel-fired burner 706 typically operates much more efficiently than most solid fossil fuel-fired burners, particularly in smaller direct-fired duty applications such as the initial evaporative duty application required in a start-up operation.

The vapor that is generated during a start-up operation flows through the tubular walls 702 and through the suspended fluid tubes 708' of the superheat panels 708. The vapor eventually flows from the furnace structure 701 through the fluid exit tubes 714 to the turbine/generator subsystem and to the regeneration subsystem, where it is transformed back into a liquid and then fed back to the furnace structure 701 through the fluid entry tubes 710.

After the initial vapor flow has been generated through the operation of the liquid fossil fuel-fired burner 706 during start-up operation, the solid fossil fuel-fired burners 704 are brought on-line to begin normal operation and to increase the rate of vapor flow through the furnace structure 701 and the entire multi-component working fluid power generation system. The solid fossil fuel-fired burners 704 typically generate very high temperature combustion gases. These high temperature combustion gases could easily damage the tubular walls 702 of the furnace structure 701 if the initial vapor flow that was generated through the operation of the liquid fossil fuel-fired burner 706 during start-up operation was not present. That is, the initial vapor flow that was generated through the operation of the liquid fossil fuel-fired burner 706 during start-up operation acts to cool the tubular walls 702 of the furnace structure 701 during the beginning stages of normal operation, thereby preventing any overheating and subsequent damage to the tubular walls 702 of the furnace structure 701 caused by the high temperature combustion gases generated by the solid fossil fuel-fired burners 704.

During normal operation, the liquid fossil fuel-fired burner 706 is secured allowing the solid fossil fuel-fired burners to continue to perform evaporative duty on the liquid binary working fluid 712 as the liquid binary working fluid 712 flows into the furnace structure 701 from the regeneration subsystem through the fluid entry tubes 710. The solid fossil fuel-fired burners 704 may also perform some evaporative duty on any of the liquid binary working fluid 712 that was not vaporized by the combustion gases generated by the liquid fossil fuel-fired burner 706. However, since the liquid fossil fuel-fired burner 706 vaporizes a substantial portion of the liquid binary working fluid 712, most of the process heat generated by the solid fossil fuel-fired burners 704 goes toward superheating duty. Thus, the superheat panels 708, which are generally larger than typical superheat panels, are hung so as to extend down into the area of the solid fossil fuel-fired burners 704 where the process heat generated by the solid fossil fuel-fired burners 704 is at very high temperature levels and thereby conducive to superheating duty. The large superheat panels 708 also serve to cover the tubular walls 702 of the furnace structure 701, thereby preventing any overheating and subsequent damage to the tubular walls 702 of the furnace structure 701 which may occur due to the high temperature combustion gases generated by the solid fossil fuel-fired burners 704 during normal operation.

The superheated binary working fluid 716 that is generated during normal operation flows from the furnace structure 701 through the fluid exit tubes 714 to the turbine/generator subsystem where the superheated binary working fluid 716 is typically used to generate electrical power. The binary working fluid is thereafter transformed back into a liquid in the regeneration subsystem and then fed back to the furnace structure 701 from the regeneration subsystem through the fluid entry tubes 710.

Figure 8:
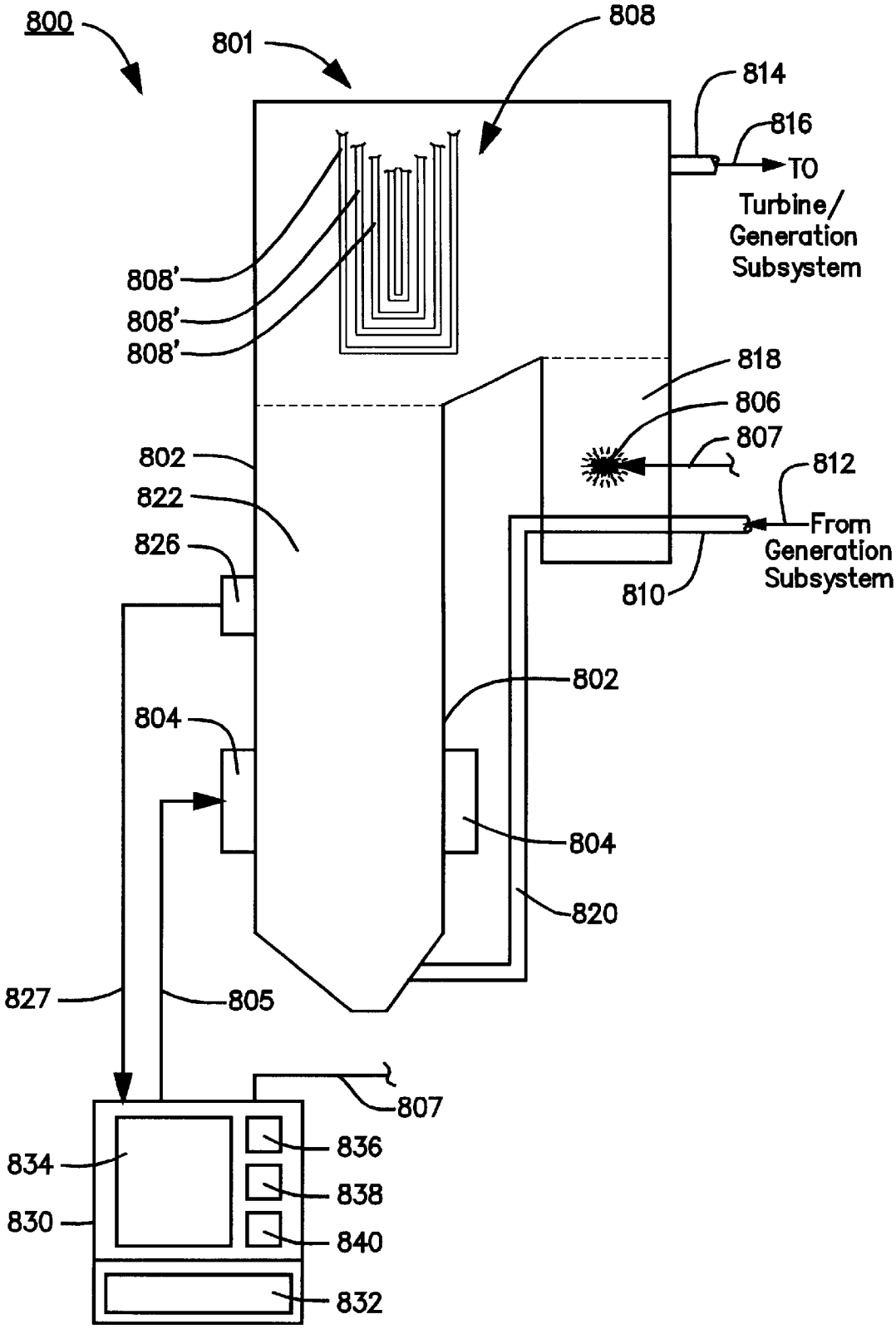
FIG. 8 illustrates a furnace system having a liquid fossil fuel-fired burner in a backpass section and a solid fossil fuel fired burner in a primary section of a furnace structure in accordance with the present invention.

FIG. 8 also illustrates a furnace system 800 for use in a multi-component working fluid power generation system in accordance with the present invention. The furnace system 800 includes a furnace structure 801 comprising tubular walls 802 and a single bank of solid fossil fuel-fired burners 804, which are located in the tubular walls 802. The furnace structure 801 also comprises a liquid fossil fuel-fired burner 806 and one or more hanging superheat panels 808 formed of suspended fluid tubes 808'. The furnace structure 801 further comprises a vapor flow sensor 826 for sensing the vapor flow through the tubular walls 802 of the furnace structure 801. The furnace structure 801 still further comprises one or more fluid entry tubes 810 for conveying liquid binary working fluid 812 to the furnace structure 801, and one or more fluid exit tubes 814 for conveying superheated binary working fluid 816 from the furnace structure 801. The liquid binary working fluid 812 typically flows to the furnace structure 801 from a regeneration subsystem (not shown) of a multi-component working fluid power generation system, and the superheated binary working fluid 816 typically flows from the furnace structure 801 to a turbine/generator subsystem (not shown) of a multi-component working fluid power generation system.

The furnace structure 801 in FIG. 8 differs from the furnace structure 701 in FIG. 7 in that the liquid fossil fuel-fired burner 806 is located in the backpass section 818 of the furnace structure 801, whereas the liquid fossil fuel-fired burner 706 is located in the boiler section of the furnace structure 701. This is significant in that the solid fossil fuel-fired burners 804 in the furnace structure 801 can be used exclusively to perform superheating duty, as described in detail below.

The furnace system 800 also includes a controller 830, which includes a keyboard 832 for receiving information provided as an input from a user and a monitor 834 for displaying information to a user. It should be understood that other types of input devices, e.g., a keypad, mouse, touch screen or other devices, and other types of output devices, e.g., a printer, voice synthesizer or other devices, could be substituted if desired for the keyboard 832 and monitor 834, respectively. The controller 830 also includes logic 836, which will typically be in the form of hardware logic devices or software logic stored on a medium, and a processor 838 for processing, in accordance with the logic 836, information provided as an input by a user via the keyboard 832. The processor 838, in accordance with the logic 836, also processes control signals received from the vapor flow sensor 826 via communications line 827, and generates and directs the transmission of control signals to the solid fossil fuel-fired burners 804 via communications line 805 so as to control the operation of the solid fossil fuel-fired burners 804, and to the liquid fossil fuel-fired burner 806 via communications line 807 so as to control the operation of the liquid fossil fuel-fired burner 806, as described in detail below. The logic 836 may include an algorithm or an access instruction to a look-up table having a burner index with preselected burner set points or other data stored in a memory 840 of the controller 830 which can be used to determine the appropriate level of operation for the burners 804, 806 based upon received vapor flow information from vapor flow sensor 826.

During start-up operation, the liquid fossil fuel-fired burner 806 is brought on-line so as to perform evaporative duty on the liquid binary working fluid 812 as the liquid binary working fluid 812 flows through the backpass section 818 of the furnace structure 801. The vapor that is generated from this evaporative duty flows from the backpass section 818 of the furnace structure 801 to a primary section 822 of the furnace structure 801 through one or more fluid transfer tubes 820. The vapor then flows through the tubular walls 802 and the suspended fluid tubes 808' of the superheat panels 808. The vapor eventually flows from the furnace structure 801 through the fluid exit tubes 814 to the turbine/generator subsystem and to the regeneration subsystem, where the vapor is transformed back into a liquid and then fed back to the furnace structure 801 through the fluid entry tubes 810.

After the initial vapor flow has been generated through the operation of the liquid fossil fuel-fired burner 806 during start-up operation, the solid fossil fuel-fired burners 804 are brought on-line to begin normal operation and to increase the rate of vapor flow through the furnace structure 801 and the entire multi-component working fluid power generation system. As with the solid fossil fuel-fired burners 704 in the furnace structure 701 of FIG. 7, the solid fossil fuel-fired burners 804 typically generate very high temperature combustion gases. These high temperature combustion gases could easily damage the tubular walls 802 of the furnace structure 801 if the initial vapor flow that was generated through the operation of the liquid fossil fuel-fired burner 806 during start-up operation was not present. That is, the initial vapor flow that was generated through the operation of the liquid fossil fuel-fired burner 806 during start-up operation acts to cool the tubular walls 802 of the furnace structure 801 during the beginning stages of normal operation, thereby preventing any overheating and subsequent damage to the tubular walls 802 of the furnace structure 801 caused by the high temperature combustion gases generated by the solid fossil fuel-fired burners 804.

During normal operation, the liquid fossil fuel-fired burner 806 is brought off-line since the solid fossil fuel-fired burners 804 generate enough process heat to evaporate the liquid binary working fluid 812 as the liquid binary working fluid 812 flows through the backpass section 818 of the furnace structure 801. As in start-up operation, the vapor that is generated in the backpass section 818 of the furnace structure 801 during normal operation works to cool the tubular walls 802 of the furnace structure 801. However, during normal operation, the vapor that is generated in the backpass section 818 of the furnace structure 801 also becomes superheated as the vapor flows through the tubular walls 802 of the furnace structure 801. That is, during normal operation, the vapor that is generated in the backpass section 818 of the furnace structure 801 flows from the backpass section 818 of the furnace structure 801 to the primary section 822 of the furnace structure 801 through the fluid transfer tubes 820. The vapor is then superheated by the process heat generated by the solid fossil fuel fired burners 804 as the vapor flows through the tubular walls 802 and the suspended fluid tubes 808' of the superheat panels 808. Thereafter, the superheated binary working fluid 816 flows from the furnace structure 801 through the fluid exit tubes 814 to the turbine/generator subsystem where the superheated binary working fluid 816 is typically used to generate electrical power. The superheated binary working fluid 816 is then transformed back into a liquid in the regeneration subsystem and then fed back to the furnace structure 801 from the regeneration subsystem through the fluid entry tubes 810.

At this point it should be noted that since the primary section 822 of the furnace structure 801 is operating exclusively as a superheater during normal operation, the superheat panels 808 may not be required, thereby simplifying the design of the furnace structure 801.

Figure 9:
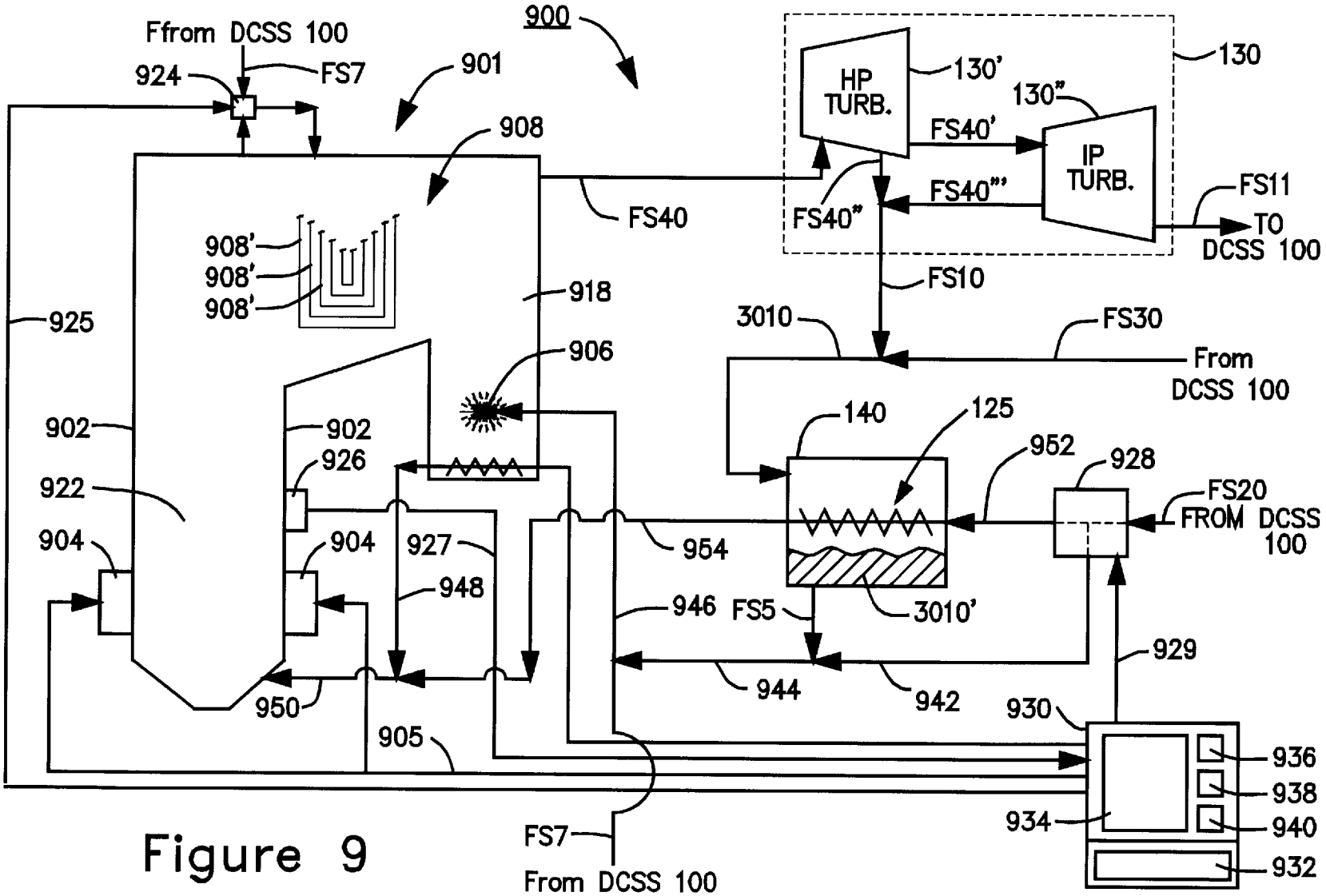
FIG. 9 illustrates a multi-component working fluid power generation system incorporating the furnace system of FIG. 8 in accordance with the present invention.

FIG. 9 illustrates a multi-component working fluid power generation system 900 incorporating some of the principles discussed above with reference to FIG. 8, and also incorporating some of the functions discussed above with reference to FIGS. 1–6. The multi-component working fluid power generation system 900 comprises a furnace structure 901 which is similar to the furnace structure 801 in FIG. 8 by having tubular walls 902, a single bank of solid fossil fuel-fired burners 904 in a primary section 922 of the furnace structure 901, a liquid fossil fuel-fired burner 906 in a backpass section 918 of the furnace structure 901, and one or more hanging superheat panels 908 formed of suspended fluid tubes 908'. The furnace structure 901 in FIG. 9 is also similar to the furnace structure 801 in FIG. 8 in that the primary section 922 of the furnace structure 901 is operating exclusively as a superheater during normal operation. Thus, similar to the superheat panels 808, the superheat panels 908 may not be required, thereby simplifying the design of the furnace structure 901.

The multi-component working fluid power generation system 900 also comprises one or more spray stations 924 for controlling the temperature of superheated working fluid flowing through the tubing of the furnace structure 901, a vapor flow sensor 926, a single input/dual output valve device 928, and a controller 930, which includes a keyboard 932 for receiving information provided as an input from a user and a monitor 934 for displaying information to a user. It should be understood that other types of input devices, e.g., a keypad, mouse, touch screen or other devices, and other types of output devices, e.g., a printer, voice synthesizer or other devices, could be substituted if desired for the keyboard 932 and monitor 934, respectively. The controller 930 also includes logic 936, which will typically be in the form of hardware logic devices or software logic stored on a medium, and a processor 938 for processing, in accordance with the logic 936, information provided as an input by a user via the keyboard 932. The processor 938, in accordance with the logic 936, also processes control signals received from the vapor flow sensor 926 via communications line 927, and generates and directs the transmission of control signals to the spray stations 924 via communications line 925 so as to control the temperature of superheated working fluid flowing through the tubing of the furnace structure 901, to the valve device 928 via communications line 929 so as to control the flow path of working fluid stream FS 20, to the solid fossil fuel-fired burners 904 via communications line 905 so as to control the operation of the solid fossil fuel-fired burners 904, and to the liquid fossil fuel-fired burner 906 via communications line 907 so as to control the operation of the liquid fossil fuel-fired burners 906, as described in detail below. The logic 936 may include an algorithm or an access instruction to a look-up table having a flow index with preselected flow set points or other data stored in a memory 940 of the controller 930 which can be used to determine the appropriate flow path setting for the valve device 928 based upon received vapor flow information from vapor flow sensor 926. Similarly, the logic 936 may include an algorithm or an access instruction to a look-up table having a burner index with preselected burner set points or other data stored in the memory 940 of the controller 930 which can be used to determine the appropriate level of operation for the burners 904, 906 based upon received vapor flow information from vapor flow sensor 926.

As previously noted, the primary section 922 of the furnace structure 901 operates exclusively as a superheater during normal operation. The multi-component working fluid power generation system 900 allows for such operation by overcoming the fact that there would be insufficient vapor flow to cool the tubular walls 902 of the furnace structure 901 if the solid fossil fuel-fired burners 904 were brought on-line at the beginning of start-up operation. This lack of sufficient vapor flow through the furnace structure 901 would also result in a failure of the TGSS 130 to provide hot fluid streams to both the DCSS 100 and the RHE 140, which would result in the failure of these subsystems to perform their designated regeneration functions. The multi-component working fluid power generation system 900 overcomes these potential failures through a reconfiguration process controlled by the controller 930. More particularly, during start-up operation, the controller 930 configures the multi-component working fluid power generation system 900 such that the valve device 928 directs the liquid working fluid stream FS 20 along flow path 942 where the liquid working fluid stream FS 20 is combined with the liquid working fluid stream FS 5 and directed along flow path 944. The combination of liquid working fluid stream FS 20 and liquid working fluid stream FS 5 is then combined with liquid working fluid stream FS 7 and directed along flow path 946 to the backpass section 918 of the furnace structure 901. The controller 930 also brings the liquid fossil fuel-fired burner 906 on-line during start-up operation so as to perform evaporative duty on the combination of liquid working fluid stream FS 20, liquid working fluid stream FS 5, and liquid working fluid stream FS 7 as the combination of these three liquid working fluid streams flows through the backpass section 918 of the furnace structure 901. The vapor that is generated from this evaporative duty flows from the backpass section 918 of the furnace structure 901 to the primary section 922 of the furnace structure 901 along flow paths 948 and 950. The vapor then flows through the tubular walls 902 and the suspended fluid tubes 908' of the superheat panels 908. The vapor eventually flows from the furnace structure 901 as hot working fluid stream FS 40 to the TGSS 130 where hot working fluid streams FS 40" and FS 40"' are extracted and thereafter combined with hot working fluid stream FS 30 to form hot working fluid stream 3010. As described below, hot working fluid stream 3010 is eventually used to vaporize cold working fluid stream FS 20 in the RHE 140.

Throughout start-up operation, the vapor flow sensor 926 provides vapor flow information to the controller 930. Once it is determined that a sufficient amount of initial vapor flow has been generated through the operation of the liquid fossil fuel-fired burner 906 during start-up operation, the controller 930 brings the solid fossil fuel-fired burners 904 on-line to begin normal operation and to increase the rate of vapor flow through the furnace structure 901 and the entire multi-component working fluid power generation system 900. As with the solid fossil fuel-fired burners 804 in the furnace structure 801 of FIG. 8, the solid fossil fuel-fired burners 904 typically generate very high temperature combustion gases. These high temperature combustion gases could easily damage the tubular walls 902 of the furnace structure 901 if the initial vapor flow that was generated through the operation of the liquid fossil fuel-fired burner 906 during start-up operation was not present. That is, the initial vapor flow that was generated through the operation of the liquid fossil fuel-fired burner 906 during start-up operation acts to cool the tubular walls 902 of the furnace structure 901 during the beginning stages of normal operation, thereby preventing any overheating and subsequent damage to the tubular walls 902 of the furnace structure 901 caused by the high temperature combustion gases generated by the solid fossil fuel-fired burners 904.

After the solid fossil fuel-fired burners 904 are brought on-line at the start of normal operation, the liquid fossil fuel-fired burner 906 is brought off-line since the solid fossil fuel-fired burners 904 generate enough process heat to evaporate the liquid working fluid flowing through the backpass section 918 of the furnace structure 901. As in start-up operation, the vapor that is generated in the backpass section 918 of the furnace structure 901 during normal operation works to cool the tubular walls 902 of the furnace structure 901. However, during normal operation, the vapor that is generated in the backpass section 918 of the furnace structure 901 also becomes superheated as the vapor flows through the tubular walls 902 of the furnace structure 901. That is, during normal operation, the vapor that is generated in the backpass section 918 of the furnace structure 901 flows from the backpass section 918 of the furnace structure 901 to the primary section 922 of the furnace structure 901 along flow paths 948 and 950. The vapor is then superheated by the process heat generated by the solid fossil fuel-fired burners 904 as the vapor flows through the tubular walls 902 and the suspended fluid tubes 908' of the superheat panels 908. At this point, the spray stations 924, with input from liquid working fluid stream FS 7, can be used to control the temperature of the superheated working fluid flowing through the tubing of the furnace structure 901. Eventually, the superheated working fluid flows from the furnace structure 901 as superheated working fluid stream FS 40 to the TGSS 130 where the superheated working fluid is typically used to generate electrical power.

As previously described, hot working fluid streams FS 40" and FS 40"' are extracted from the TGSS 130 and thereafter combined with hot working fluid stream FS 30 to form hot working fluid stream 3010. During start-up operation, the temperature of working fluid stream 3010 is generally not hot enough to vaporize the cold working fluid stream FS 20 in the RHE 140. However, during normal operation, the temperature of working fluid stream 3010 is hot enough to vaporize the cold working fluid stream FS 20 in the RHE 140. Therefore, during normal operation, the controller 930 reconfigures the multi-component working fluid power generation system 900 such that the valve device 928 directs the cold liquid working fluid stream FS 20 along flow path 952 to the RHE 140. The cold liquid working fluid stream FS 20 can then be vaporized by the hot working fluid stream 3010 in the RHE 140. Thereafter, this vaporized working fluid is directed along flow path 954. During this same process, the hot working fluid stream 3010 is condensed by the cold liquid working fluid stream FS 20 in the RHE 140, thereby forming condensate 3010'. Thereafter, the condensate 3010' is directed, as liquid working fluid stream FS 5, along flow path 944 where liquid working fluid stream FS 5 is combined with the liquid working fluid stream FS 7. The combination of liquid working fluid stream FS 5 and liquid working fluid stream FS 7 is then directed along flow path 946 to the backpass section 918 of the furnace structure 901, where this combination of two liquid working fluid streams is vaporized by the process heat generated by the solid fossil fuel-fired burners 904. The vaporized working fluid that is generated in the backpass section 918 of the furnace structure 901 is then directed along flow path 948, where this vaporized working fluid is combined with the vaporized working fluid that was generated in the RHE 140 and directed along flow path 954. The combination of the vaporized working fluid from the RHE 140 and the vaporized working fluid from the backpass section 918 of the furnace structure 901 is then directed to the primary section 922 of the furnace structure 901 along flow path 950, where this combination of vaporized working fluids is superheated by the process heat generated by the solid fossil fuel-fired burners 904.

Figure 10:
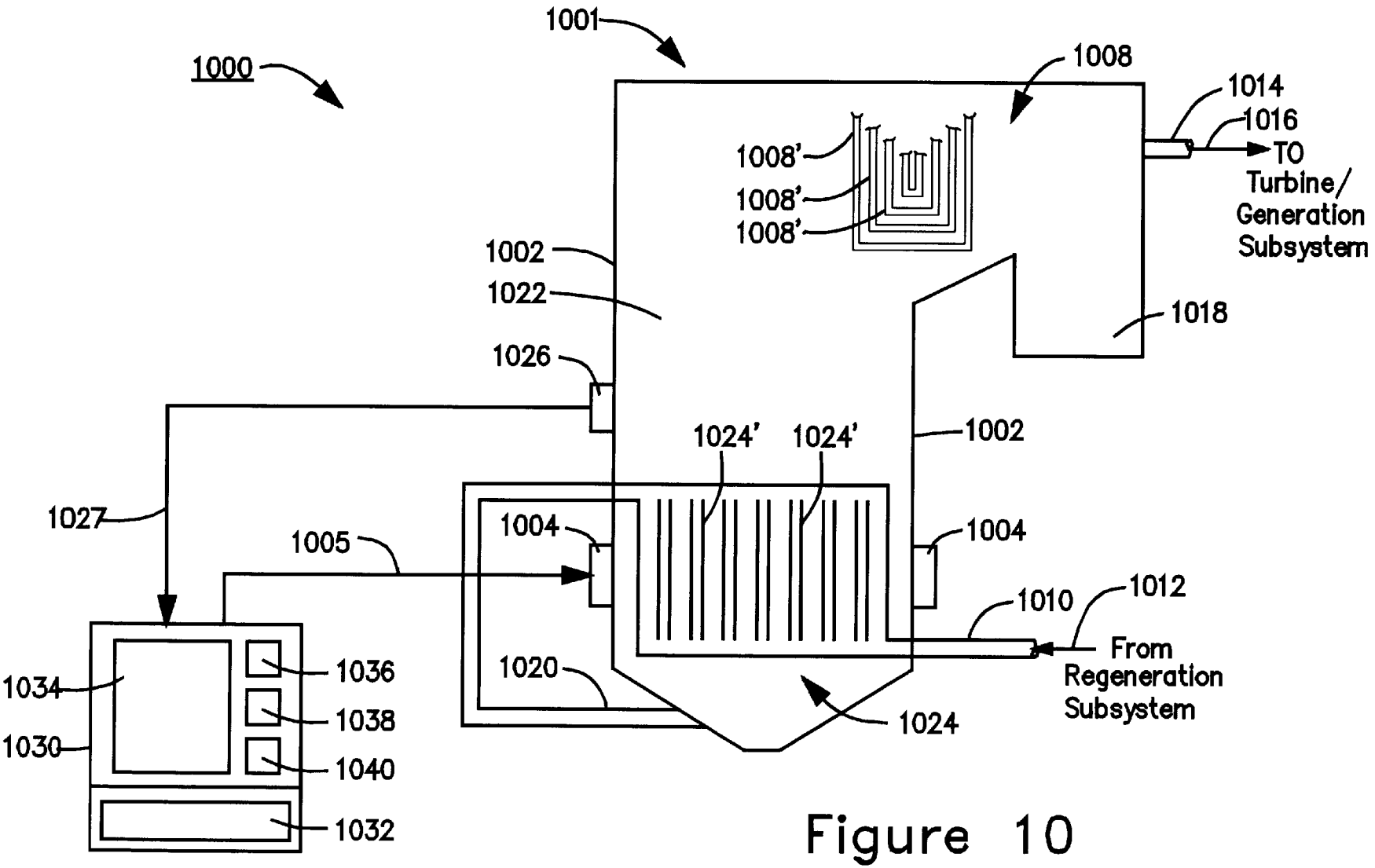
FIG. 10 illustrates a furnace system having an inner tubular wall and an outer tubular wall in accordance with the present invention.

FIG. 10 illustrates another furnace system 1000 for use in a multi-component working fluid power generation system in accordance with the present invention. The furnace system 1000 includes a furnace structure 1001 comprising tubular walls 1002 and a single bank of solid fossil fuel-fired burners 1004, which are located in the tubular walls 1002. The furnace structure 1001 also comprises one or more hanging superheat panels 1008 formed of suspended fluid tubes 1008'. The furnace structure 1001 further comprises a vapor flow sensor 1026 for sensing the vapor flow through the tubular walls 1002 of the furnace structure 1001. The furnace structure 1001 still further comprises one or more fluid entry tubes 1010 for conveying liquid binary working fluid 1012 to the furnace structure 1001, and one or more fluid exit tubes 1014 for conveying superheated binary working fluid 1016 from the furnace structure 1001. The liquid binary working fluid 1012 typically flows to the furnace structure 1001 from a regeneration subsystem (not shown) of a multi-component working fluid power generation system, and the superheated binary working fluid 1016 typically flows from the furnace structure 1001 to a turbine/generator subsystem (not shown) of a multi-component working fluid power generation system.

The furnace structure 1001 in FIG. 10 differs from the furnace structure 701 in FIG. 7 and the furnace structure 801 in FIG. 8 in that no liquid fossil fuel-fired burner is required to perform evaporative duty. Instead, the furnace structure 100 comprises an inner tubular wall 1024 formed of loose fluid tubes 1024' located adjacent to the solid fossil fuel-fired burners 1004 for performing evaporative duty. This is significant in that the solid fossil fuel-fired burners 1004 in the furnace structure 1001 can be used to perform both evaporative and superheating duty at the same time, as described in detail below.

The furnace system 1000 also includes a controller 1030, which includes a keyboard 1032 for receiving information provided as an input from a user and a monitor 1034 for displaying information to a user. It should be understood that other types of input devices, e.g., a keypad, mouse, touch screen or other devices, and other types of output devices, e.g., a printer, voice synthesizer or other devices, could be substituted if desired for the keyboard 1032 and monitor 1034, respectively. The controller 1030 also includes logic 1036, which will typically be in the form of hardware logic devices or software logic stored on a medium, and a processor 1038 for processing, in accordance with the logic 1036, information provided as an input by a user via the keyboard 1032. The processor 1038, in accordance with the logic 1036, also processes control signals received from the vapor flow sensor 1026 via communications line 1027, and generates and directs the transmission of control signals to the solid fossil fuel-fired burners 1004 via communications line 1005 so as to control the operation of the solid fossil fuel-fired burners 1004, as described in detail below. The logic 1036 may include an algorithm or an access instruction to a look-up table having a burner index with preselected burner set points or other data stored in a memory 1040 of the controller 1030 which can be used to determine the appropriate level of operation for the solid fossil fuel-fired burners 1004 based upon received vapor flow information from vapor flow sensor 1026.

During start-up operation, the solid fossil fuel-fired burners 1004 are brought on-line at a low level so as to perform evaporative duty on the liquid binary working fluid 1012 as the liquid binary working fluid 1012 flows through the loose fluid tubes 1024' of the inner tubular wall 1024. The vapor that is generated from this evaporative duty flows from the inner tubular wall 1024 to a primary section 1022 of the furnace structure 1001 through one or more fluid transfer tubes 1020. The vapor then flows through the tubular walls 1002 and the suspended tubular tubes 1008' of the superheat panels 1008. The vapor eventually flows from the furnace structure 1001 through the fluid exit tubes 1014 to the turbine/generator subsystem and to the regeneration subsystem, where the vapor is transformed back into a liquid and then fed back to the furnace structure 1001 through the fluid entry tubes 1010.

After the initial vapor flow has been generated through the low level operation of the solid fossil fuel-fired burners 1004 during start-up operation, the level of operation of the solid fossil fuel-fired burners 1004 is gradually increased to begin normal operation and to increase the rate of vapor flow through the furnace structure 1001 and the entire multi-component working fluid power generation system. As with the solid fossil fuel-fired burners 704 in the furnace structure 701 of FIG. 7 and the solid fossil fuel-fired burners 804 in the furnace structure 801 of FIG. 8, the solid fossil fuel-fired burners 1004 typically generate very high temperature combustion gases at normal operation. These high temperature combustion gases could easily damage the tubular walls 1002 of the furnace structure 1001 if the initial vapor flow that was generated through the low level operation of the solid fossil fuel-fired burners 1004 during startup operation was not present. That is, the initial vapor flow that was generated through the low level operation of the solid fossil fuel-fired burners 1004 during start-up operation acts to cool the tubular walls 1002 of the furnace structure 1001 during the beginning stages of normal operation, thereby preventing any overheating and subsequent damage to the tubular walls 1002 of the furnace structure 1001 caused by the high temperature combustion gases generated by the solid fossil fuel-fired burners 1004. It should also be noted that the inner tubular wall 1024 also serves to protect the tubular walls 1002 of the furnace structure 1001 by shielding the tubular walls 1002 from the solid fossil fuel-fired burners 1004.

As in start-up operation, the vapor that is generated in the inner fluid walls 1024 during normal operation works to cool the tubular walls 1002 of the furnace structure 1001. However, during normal operation, the vapor that is generated in the inner tubular walls 1024 also becomes superheated as the vapor flows through the tubular walls 1002 of the furnace structure 1001. That is, during normal operation, the vapor that is generated in the inner tubular walls 1024 flows from the inner tubular walls 1024 to the primary section 1022 of the furnace structure 1001 through the fluid transfer tubes 1020. The vapor is then superheated by the process heat generated by the solid fossil fuel-fired burners 1004 as the vapor flows through the tubular walls 1002 and the suspended fluid tubes 1008' of the superheat panels 1008. Thereafter, the superheated binary working fluid 1016 flows from the furnace structure 1001 through the fluid exit tubes 1014 to the turbine/generator subsystem where the superheated binary working fluid 1016 is typically used to generate electrical power. The superheated binary working fluid 1016 is then transformed back into a liquid in the regeneration subsystem and thereafter fed back to the furnace structure 1001 from the regeneration subsystem through the fluid entry tubes 1010.

At this point it should be noted that since the primary section 1022 of the furnace structure 1001 is operating exclusively as a superheater during normal operation, the superheat panels 1008 may not be required, thereby simplifying the design of the furnace structure 1001.

Figure 11:
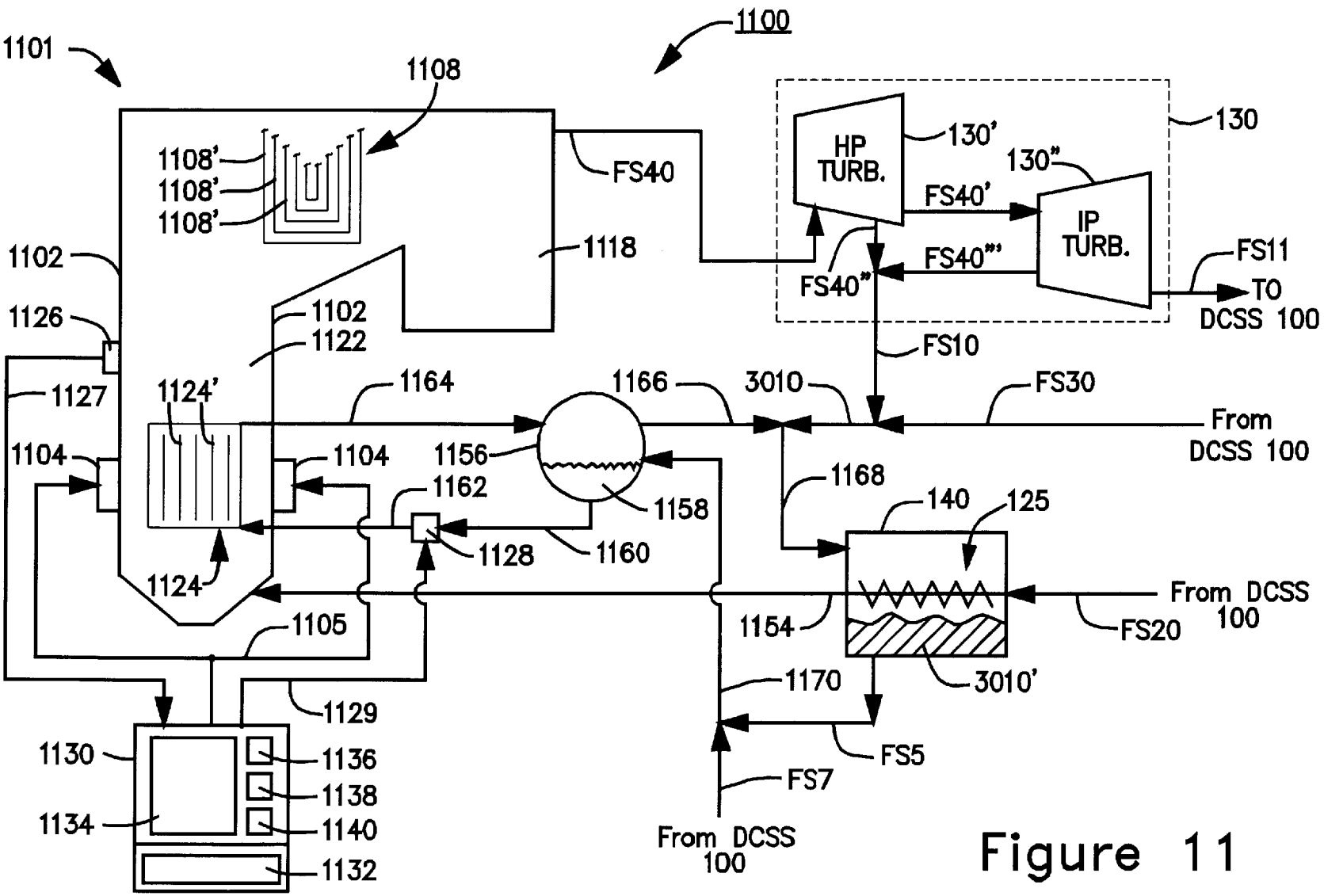
FIG. 11 illustrates a multi-component working fluid power generation system incorporating the furnace system of FIG. 10 in accordance with the present invention.

FIG. 11 illustrates a multi-component working fluid power generation system 1100 incorporating some of the principles discussed above with reference to FIG. 10, and also incorporating some of the functions discussed above with reference to FIGS. 1–6. The multi-component working fluid power generation system 1100 comprises a furnace structure 1101 which is similar to the furnace structure 1001 in FIG. 10 by having tubular walls 1102, a single bank of solid fossil fuel-fired burners 1104 in a primary section 1122 of the furnace structure 1101, an inner tubular wall 1124 formed of loose fluid tubes 1124' located adjacent to the solid fossil fuel-fired burners 1104 for performing evaporative duty, and one or more hanging superheat panels 1108 formed of suspended fluid tubes 1108'. The furnace structure 1101 in FIG. 11 is also similar to the furnace structure 1001 in FIG. 10 in that the primary section 1122 of the furnace structure 1101 is operating exclusively as a superheater during normal operation. Thus, similar to the superheat panels 1008, the superheat panels 1108 may not be required, thereby simplifying the design of the furnace structure 1101.

The multi-component working fluid power generation system 1100 also comprises a vapor flow sensor 1126, a steam drum 1156, a fluid pump 1128, and a controller 1130, which includes a keyboard 1132 for receiving information provided as an input from a user and a monitor 1134 for displaying information to a user. It should be understood that other types of input devices, e.g., a keypad, mouse, touch screen or other devices, and other types of output devices, e.g., a printer, voice synthesizer or other devices, could be substituted if desired for the keyboard 1132 and monitor 1134, respectively. The controller 1130 also includes logic 1136, which will typically be in the form of hardware logic devices or software logic stored on a medium, and a processor 1138 for processing, in accordance with the logic 1136, information provided as an input by a user via the keyboard 1132. The processor 1138, in accordance with the logic 1136, also processes control signals received from the vapor flow sensor 1126 via communications line 1127, and generates and directs the transmission of control signals to the fluid pump 1128 via communications line 1129 so as to control the flow of working fluid from the steam drum 1156 to the inner tubular wall 1124, as described in detail below. The processor 1138, in accordance with the logic 1136, further generates and directs the transmission of control signals to the solid fossil fuel-fired burners 1104 via communications line 1105 so as to control the operation of the solid fossil fuel-fired burners 1104, as described in detail below. The logic 1136 may include an algorithm or an access instruction to a look-up table having a flow index with preselected flow set points or other data stored in a memory 1140 of the controller 1130 which can be used to determine the appropriate flow setting for the fluid pump 1128 based upon received vapor flow information from vapor flow sensor 1126. Similarly, the logic 1136 may include an algorithm or an access instruction to a look-up table having a burner index with preselected burner set points or other data stored in the memory 1140 of the controller 1130 which can be used to determine the appropriate level of operation for the solid fossil fuel-fired burners 1104 based upon received vapor flow information from vapor flow sensor 1126.

As previously noted, the primary section 1122 of the furnace structure 1101 operates exclusively as a superheater during normal operation. The multi-component working fluid power generation system 1100 allows for such operation by utilizing the inner tubular wall 1124 as both a vessel for performing evaporative duty and a shield for protecting the tubular walls 1102 of the furnace structure 1101. Both of these functions of the inner tubular wall 1124 act against the process heat generated by the solid fossil fuel-fired burners 1104, as described in detail below.

During normal operation, the cold liquid working fluid stream FS 20 is vaporized, and possibly even superheated, by heat energy 125 in the RHE 140. Thereafter, this vaporized working fluid is directed along flow path 1154 to the primary section 1122 of the furnace structure 1101 where this vaporized working fluid is superheated, or even further superheated, by the process heat generated by the solid fossil fuel-fired burners 1104 as it flows through the tubular walls 1102 and the suspended fluid tubes 1108' of the superheat panels 1108. However, due to the already elevated temperature of this vaporized working fluid, the tubular walls 1102 of the furnace structure 1101 proximate to the solid fossil fuel fired burners 1104 can not be sufficiently cooled by this vaporized working fluid. Instead, the inner tubular wall 1124 is provided to perform this function.

The inner tubular wall 1124 provides cooling to the tubular walls 1102 of the furnace structure 1101 by allowing the solid fossil fuel-fired burners 1104 to perform an evaporative duty on a lean liquid working fluid 1158 as this lean liquid working fluid 1158 flows through the loose fluid tubes 1124' of the inner tubular wall 1124. The lean liquid working fluid 1158, which is supplied by the steam drum 1156, is forced along flow paths 1160 and 1162 to the inner tubular wall 1124 by the fluid pump 1128. The fluid pump 1128 further forces the lean liquid working fluid 1158 through the loose fluid tubes 1124' of the inner tubular wall 1124 where this lean liquid working fluid 1158 is evaporated by the process heat generated by the solid fossil fuel-fired burners 1104. The vapor that is generated from this evaporative duty flows along flow path 1164 back to the steam drum 1156 where a portion may be condensed back into the lean liquid working fluid 1158. However, the majority of the vapor is directed along flow path 1166, where this vapor is combined with the hot working fluid stream 3010 and directed along flow path 1168 to the RHE 140. In the RHE 140, the combination of the vapor and the hot working fluid stream 3010 transfers heat energy 125 to the cold liquid working fluid stream FS 20 which thereafter condenses to form condensate 3010'. The condensate 3010' flows from the RHE 140, as liquid working fluid stream FS 5, and is combined with the liquid working fluid stream FS 7. The combination of liquid working fluid stream FS 5 and liquid working fluid stream FS 7 is then directed along flow path 1170 to the steam drum 1156 to form the supply of lean liquid working fluid 1158.

As previously noted, the inner tubular wall 1124 may also serve as a shield for protecting the tubular walls 1102 of the furnace structure 1101 from the high temperature combustion gases generated by the solid fossil fuel-fired burners 1104. If such is the case, the fluid tubes 1124' of the inner tubular wall 1124 may or may not be interconnected by fins depending upon the degree of shielding required. That is, the fluid tubes 1124' of the inner tubular wall 1124 may be interconnected by fins so as to increase the amount of shielding that is provided to the tubular walls 1102 of the furnace structure 1101.

Figure 12:
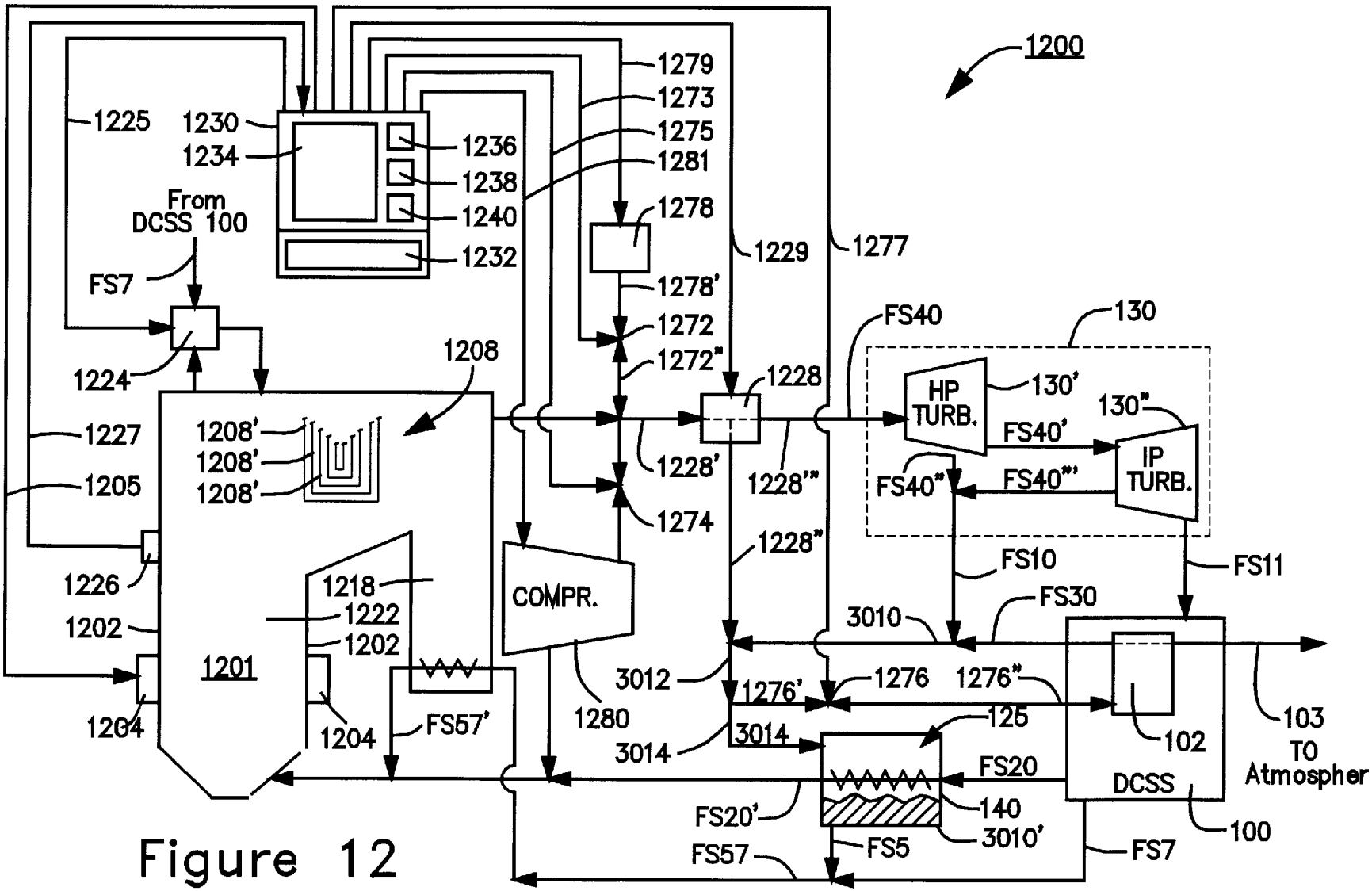
FIG. 12 illustrates a multi-component working fluid power generation system having a vapor recirculation system for providing furnace wall cooling during start-up and low-load operation in accordance with the present invention.

FIG. 12 illustrates a multi-component working fluid power generation system 1200 having a vapor recirculation system for providing furnace wall cooling during start-up and low-load operation in accordance with the present invention. The multi-component working fluid power generation system 1200 comprises a furnace structure 1201 having tubular walls 1202, a single bank of solid fossil fuel-fired burners 1204 in a primary section 1222 of the furnace structure 1201, and one or more hanging superheat panels 1208 formed of suspended fluid tubes 1208'. The multi-component working fluid power generation system 1200 also comprises one or more spray stations 1224, a vapor flow sensor 1226, a single input/dual output valve device 1228, a first conventional valve device 1272, a second conventional valve device 1274, a third conventional valve device 1276, a start-up compressor 1278, and a recirculation compressor 1280. The multi-component working fluid power generation system 1200 further comprises a controller 1230, which includes a keyboard 1232 for receiving information provided as an input from a user and a monitor 1234 for displaying information to a user. It should be understood that other types of input devices, e.g., a keypad, mouse, touch screen or other devices, and other types of output devices, e.g., a printer, voice synthesizer or other devices, could be substituted if desired for the keyboard 1232 and monitor 1234, respectively. The controller 1230 also includes logic 1236, which will typically be in the form of hardware logic devices or software logic stored on a medium, and a processor 1238 for processing, in accordance with the logic 1236, information provided as an input by a user via the keyboard 1232. The processor 1238, in accordance with the logic 1236, also processes control signals received from the vapor flow sensor 1226 via communications line 1227, and generates and directs the transmission of control signals to the solid fossil fuel-fired burners 1204 via communications line 1205 so as to control the operation of the solid fossil fuel-fired burners 1204, to the spray stations 1224 via communications line 1225 so as to control the temperature of superheated working fluid flowing through the tubing of the furnace structure 1201, to the single input/dual output valve device 1228 via communications line 1229 so as to control the operation of the single input/dual output valve device 1228, to the first conventional valve device 1272 via communications line 1273 so as to control the operation of the first conventional valve device 1272, to the second conventional valve device 1274 via communications line 1275 so as to control the operation of the second conventional valve device 1274, to the third conventional valve device 1276 via communications line 1277 so as to control the operation of the third conventional valve device 1276, to the start-up compressor 1278 via communications line 1279 so as to control the operation of the start-up compressor 1278, and to the recirculation compressor 1280 via communications line 1281 so as to control the operation of the recirculation compressor 1280, as described in detail below. The logic 1236 may include an algorithm or an access instruction to a look-up table having a flow index with preselected flow set points or other data stored in a memory 1240 of the controller 1230 which can be used to determine the appropriate settings for the single input/dual output valve device 1228, the first conventional valve device 1272, the second conventional valve device 1274, the third conventional valve device 1276, the start-up compressor 1278, and the recirculation compressor 1280 based upon received vapor flow information from vapor flow sensor 1226. Similarly, the logic 1236 may include an algorithm or an access instruction to a look-up table having a burner index with preselected burner set points or other data stored in the memory 1240 of the controller 1230 which can be used to determine the appropriate level of operation for the solid fossil fuel-fired burners 1204 based upon received vapor flow information from vapor flow sensor 1226.

During start-up operation, the controller 1230 first causes the first conventional valve device 1272 and the second conventional valve device 1274 to open, and then sets the single input/dual output valve device 1228 such that flow path 1228' is entirely directed to flow path 1228" , thereby totally disconnecting flow path 1228' from flow path 1228"' and the TGSS 130. The controller 1230 then directs the start-up compressor 1278 to inject a non-condensing vapor into the multi-component working fluid power generation system 1200 along flow paths 1272' and 1272" at a specific pressure such as, for example, 300–500 psi. The injected non-condensing vapor may be one of a variety of non-condensing vapor types such as, for example, air or nitrogen. The injected non-condensing vapor is pressurized to reduce the power required by the recirculation compressor 1280, as described in detail below.

After the non-condensing vapor is injected and the system 1200 is pressurized, the controller 1230 causes the first conventional valve device 1272 to close, thereby disconnecting flow path 1272' from flow path 1272" and sealing the injected non-condensing vapor within the system 1200. At this point it should be noted that a vapor generated in an evaporator internal to the system 1200, or a vapor generated in an evaporator external to the system 1200, could alternatively be used as the injected vapor.

After the system 1200 is sealed, the controller 1230 directs the recirculation compressor 1280 to begin recirculating the injected non-condensing vapor throughout the system 1200. That is, the recirculation compressor 1280 recirculates the injected non-condensing vapor through the tubular walls 1202, the suspended tubular tubes 1208' of the superheat panels 1208, and the RHE 140. At this point it should be noted that the third conventional valve device 1276 is in a closed state.

After the injected non-condensing vapor has begun to recirculate through the system 1200, the controller 1230 brings the solid fossil fuel-fired burners 1204 on-line at a low level so as to increase the temperature of the injected non-condensing vapor. As the temperature of the injected non-condensing vapor increases, the pressure of the injected non-condensing vapor also increases. In fact, the process heat generated from the solid fossil fuel-fired burners 1204 can alternatively be used to initially pressurize the injected non-condensing vapor in the system 1200 instead of the start-up compressor 1278. In any event, once the temperature of the injected non-condensing vapor reaches a predefined threshold such as, for example, 700 degrees Fahrenheit, a liquid binary working fluid is added to the injected non-condensing vapor. This liquid binary working fluid can be, for example, the liquid binary working fluid stream FS 7, which is added at the spray stations 1224. Alternatively, the liquid binary working fluid could be liquid working fluid stream FS 20 or liquid working fluid stream FS 30. In any event, once the liquid binary working fluid comes into contact with the high temperature injected non-condensing vapor, the liquid binary working fluid is immediately vaporized. That is, the high temperature injected non-condensing vapor vaporizes the liquid binary working fluid as the liquid binary working fluid is added to the system 1200.

More and more liquid binary working fluid is added to the system 1200 and vaporized by the high temperature injected non-condensing vapor. The combination of the injected non-condensing vapor and the working fluid vapor is recirculated through the system 1200 by the recirculation compressor 1280. Some of the vapor combination is directed along flow paths 3012 and 3014 to the RHE 140 where additional working fluid vapor is generated. At some point, the controller 1230 causes the third conventional valve device 1276 to open, thereby allowing some of the vapor combination to travel along flow paths 1276' and 1276" to the DCSS 100. The DCSS 100 includes a condenser 102 which condenses the working fluid vapor so as to form liquid working fluid stream FS 30. The condenser 102 also vents off the injected non-condensing vapor 103 to the atmosphere.

Eventually, all of the injected non-condensing vapor will be vented off and the controller 1230 will again cause the third conventional valve device 1276 to be closed. At this point, the RHE 140 is generating a sufficient amount of binary working fluid vapor to safely cool the tubular walls 1202 of the furnace structure 1201. The controller 1230 can then shut down the recirculation system by directing the recirculation compressor 1280 to stop recirculating the binary working fluid vapor, by causing the second conventional valve device 1274 to close, and by setting the single input/dual output valve device 1228 such that flow path 1228' is entirely directed to flow path 1228"', thereby totally disconnecting flow path 1228' from flow path 1228" . Heretofore, only a small amount of binary working fluid vapor (e.g., a bleed stream) was allowed to the TGSS 130 for warm-up purposes.

Throughout the above-described start-up process, the controller 1230 gradually increases the level of operation of the solid fossil fuel-fired burners 1204. Thus, during normal operation, there is sufficient process heat generated by the solid fossil fuel-fired burners 1204 such that evaporative duty can be performed on binary working fluid stream FS 57 in the backpass section 1218 of the furnace structure 1201. The vaporized binary working fluid stream FS 57' is then combined with vaporized binary working fluid stream FS 20' from the RHE 140 and directed to the primary section 1222 of the furnace structure 1201 for superheating duty. Thus, during normal operation, the primary section 1222 of the furnace structure 1201 operates exclusively as a superheater. Consequently, the superheat panels 1208 may not be required, thereby simplifying the design of the furnace structure 1201.

Figure 13:
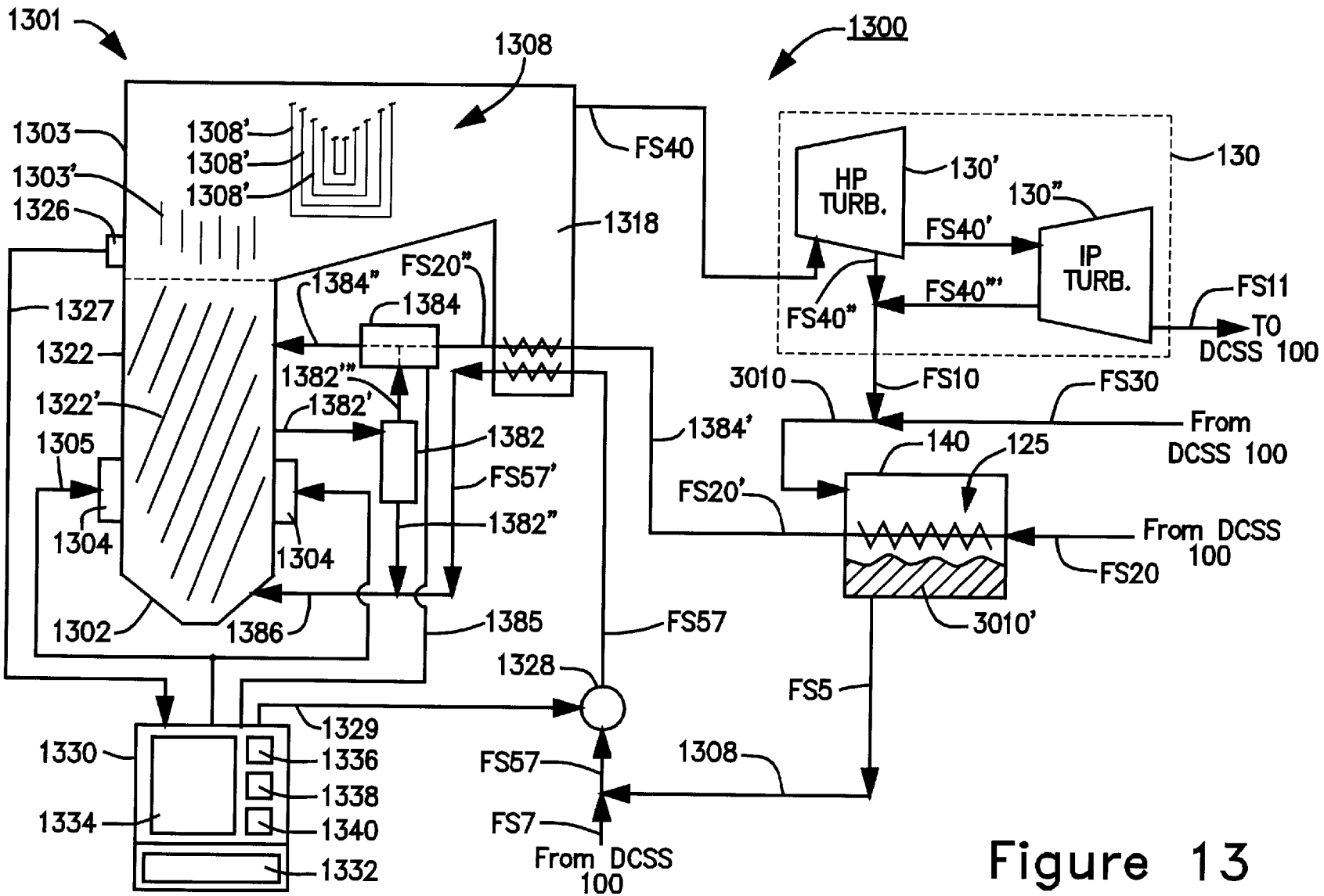
FIG. 13 illustrates a multi-component working fluid power generation system having a fluid separating/combining system for providing furnace wall cooling during start-up and normal operation in accordance with the present invention.

FIG. 13 illustrates a multi-component working fluid power generation system 1300 having a fluid separating/combining system for providing furnace wall cooling during start-up and normal operation in accordance with the present invention. The multi-component working fluid power generation system 1300 comprises a furnace structure 1301 having lower tubular walls 1302, upper tubular walls 1303, a single bank of coal-fired burners 1304 in a primary section 1322 of the furnace structure 1301, and one or more hanging superheat panels 1308 formed of suspended fluid tubes 1308'. The multi-component working fluid power generation system 1300 also comprises a vapor flow sensor 1326, a fluid pump 1328, a fluid separator 1382, and a fluid combiner 1384. The multi-component working fluid power generation system 1300 further comprises a controller 1330, which includes a keyboard 1332 for receiving information provided as an input from a user and a monitor 1334 for displaying information to a user. It should be understood that other types of input devices, e.g., a keypad, mouse, touch screen or other devices, and other types of output devices, e.g., a printer, voice synthesizer or other devices, could be substituted if desired for the keyboard 1332 and monitor 1334, respectively. The controller 1330 also includes logic 1336, which will typically be in the form of hardware logic devices or software logic stored on a medium, and a processor 1338 for processing, in accordance with the logic 1336, information provided as an input by a user via the keyboard 1332. The processor 1338, in accordance with the logic 1336, also processes control signals received from the vapor flow sensor 1326 via communications line 1327, and generates and directs the transmission of control signals to the solid fossil fuel-fired burners 1304 via communications line 1305 so as to control the operation of the solid fossil fuel-fired burners 1304, to the fluid pump 1328 via communications line 1329 so as to control the operation of the fluid pump 1328, and to a fluid combiner 1384 via communications line 1385 so as to control the operation of the fluid combiner 1384, as described in detail below. The logic 1336 may include an algorithm or an access instruction to a look-up table having a flow index with preselected flow set points or other data stored in a memory 1340 of the controller 1330 which can be used to determine the appropriate settings for the fluid pump 1328 and the fluid combiner 1384 based upon received vapor flow information from vapor flow sensor 1326. Similarly, the logic 1336 may include an algorithm or an access instruction to a look-up table having a burner index with preselected burner set points or other data stored in the memory 1340 of the controller 1330 which can be used to determine the appropriate level of operation for the solid fossil fuel-fired burners 1304 based upon received vapor flow information from vapor flow sensor 1326.

During start-up operation, the controller 1330 first brings the solid fossil fuel-fired burners 1304 on-line at a low level, and sets the fluid combiner 1384 such that flow path 1384" accepts fluid flows from only flow path 1382'", thereby totally disconnecting flow path 1384' from flow path 1384". The controller 1330 then directs the fluid pump 1328 to force a lean liquid working fluid stream FS 57 along flow path 1357 to the backpass section 1318 of the furnace structure 1301 for preheating duty by the combustion gases generated by the solid fossil fuel-fired burners 1304. The fluid pump 1328 then forces a preheated lean liquid working fluid stream FS 57' along flow path 1386 to the primary section 1322 of the furnace structure 1301 for evaporative duty in the lower tubular walls 1302 of the furnace structure 1301.

The lower tubular walls 1302, have spiral fluid tubes 1302' so as to provide a long flow path length for the preheated lean liquid working fluid stream FS 57' as the preheated lean liquid working fluid FS 57 flows through the lower tubular walls 1302 for the evaporative duty. However, due to the low level operation of the solid fossil fuel-fired burners 1304, and the high boiling point of the preheated lean liquid working fluid stream FS 57', only a portion of the preheated lean liquid working fluid stream FS 57' becomes vaporized in the lower tubular walls 1302 during start-up operation. The resulting vapor/liquid mixture is directed from the lower tubular walls 1302 along flow path 1382' to the fluid separator 1382, from which vapor is directed to the fluid combiner 1384 along flow path 1382" and liquid is directed along flow path 1382" where this liquid is combined with the preheated lean liquid working fluid stream FS 57' and again forced along flow path 1386 to the primary section 1322 of the furnace structure 1301 for evaporative duty in the lower tubular walls 1302 of the furnace structure 1301. The vapor that is directed to the fluid combiner 1384 along flow path 1382" is, further directed along flow path 1384" to the upper tubular walls 1303 for further evaporative duty. The upper tubular walls 1303 are shown having vertical fluid tubes 1303', but other types of fluid tubes (e.g., spiral, ribbed, etc.) are also possible depending upon flow rate.

During start-up operation, the vapor that is generated in the upper tubular walls 1303, and also in the suspended fluid tubes 1308' of the superheat panels 1308, eventually flows from the furnace structure 1301 as hot working fluid stream FS 40 to the TGSS 130 where hot working fluid streams FS 40" and FS 40'" are extracted and thereafter combined with hot working fluid stream FS to form hot working fluid stream 3010. As described below, hot working fluid stream 3010 is eventually used to vaporize rich cold working fluid stream FS 20 in the RHE 140.

At this point it should be noted that temperature differences can occur in different portions of the preheated lean liquid working fluid stream FS 57' as it flows through the lower tubular walls 1302 for the evaporative duty. That is, some of the fluid tubes 1302' in the lower tubular walls 1302 may become hotter than others depending upon the proximity of each individual fluid tubes 1302' to the solid fossil fuel-fired burners 1304. Thus, some portions of the preheated lean liquid working fluid stream FS 57' flowing through fluid tubes 1302' will absorb more heat than other portions, thereby resulting in temperature differences in different portions of the preheated lean liquid working fluid stream FS 57' at the outputs of the fluid tubes 1302'. However, these fluid temperature differences are not carried over to the upper tubular walls 1303 since all of lean liquid working fluid stream FS 57' is recombined and directed along flow path 1382' to the fluid separator 1382, from which vapor is directed to the fluid combiner 1384 along flow path 1382'" and then to the upper tubular walls 1303 along flow path 1384". Thus, a more uniform temperature is maintained in the upper tubular walls 1303.

Throughout start-up operation, the vapor flow sensor 1326 provides vapor flow information to the controller 1330. Once it is determined that a sufficient amount of initial vapor flow has been generated to cool the furnace walls, the controller 1330 increases the operation elevation of the solid fossil fuel-fired burners 1304 to begin normal operation and to increase the rate of vapor flow through the furnace structure 1301 and the entire multi-component working fluid power generation system 1300. At this time, the controller 1330 also resets the fluid combiner 1384 such that flow path 1384" accepts fluid flows from both flow path 1382'" and flow path 1384', which carries a rich vaporized working fluid stream FS 20' that is preheated in the backpass section 1318 of the furnace structure 1301. Thus, during normal operation, the vapor that is generated in the lower tubular walls 1302 of the furnace structure 1301 is combined with a preheated rich vaporized working fluid stream FS 20" and then directed along flow path 1384" to the upper tubular walls 1303 and the suspended fluid tubes 1308' of the superheat panels 1308 for superheating duty. Eventually, the superheated working fluid flows from the furnace structure 1301 as superheated working fluid stream FS 40 to the TGSS 130 where this superheated working fluid is typically used to generate electrical power.

As previously described, hot working fluid streams FS 40" and FS 40'" are extracted from the TGSS 130 and thereafter combined with hot working fluid stream FS 30 to form hot working fluid stream 3010. During start-up operation, the temperature of working fluid stream 3010 is generally not hot enough to vaporize the cold working fluid stream FS 20 in the RHE 140. However, during normal operation, the temperature of working fluid stream 3010 is hot enough to vaporize the rich cold working fluid stream FS 20 in the RHE 140, thereby generating rich vaporized working fluid stream FS 20' which is directed along flow path 1384' to the backpass section 1318 of the furnace structure 1301. During this same process, the hot working fluid stream 3010 is condensed by the cold liquid working fluid stream FS 20 in the RHE 140, thereby forming condensate 3010'. Thereafter, the condensate 3010' is directed, as liquid working fluid stream FS 5, along flow path 1388 where this liquid working fluid stream FS 5 is combined with the liquid working fluid stream FS 7 to form lean liquid working fluid stream FS 57. As previously described, the controller 1330 then directs the fluid pump 1328 to force the lean liquid working fluid stream FS 57 along flow path 1357 to the backpass section 1318 of the furnace structure 1301.

As the operation elevation of the solid fossil fuel-fired burners 904 is increased during normal operation, the process heat generated by the solid fossil fuel-fired burners 1304 is similarly increased, thereby causing the lean liquid working fluid stream FS 57 to be vaporized and the rich vaporized working fluid stream FS 20' to be superheated in the backpass section 1318 of the furnace structure 1301. The lean vaporized working fluid that is generated in the backpass section 1318 of the furnace structure 1301 is directed along flow path 1386 to the primary section 1322 of the furnace structure 1301 for superheating duty in the lower tubular walls 1302 of the furnace structure 1301. The resulting lean superheated vapor is directed from the lower tubular walls 1302 along flow path 1382' to the fluid separator 1382, where this resulting lean superheated vapor is then directed to the fluid combiner 1384 along flow path 1382'''. That is, during normal operation, all of the fluid that is directed from the lower tubular walls 1302 to the fluid separator 1382 is directed to the fluid combiner 1384 since no liquid is present.

The lean superheated vapor that is generated in the lower tubular walls 1302 of the furnace structure 1301 and the rich superheated vapor that is generated in the backpass section 1318 of the furnace structure 1301 are combined in the fluid combiner 1384 and directed along flow path 1384'' to the upper tubular walls 1303 for further superheating duty.

As is apparent from the foregoing description, the primary section 1322 of the furnace structure 1301 operates exclusively as a superheater during normal operation. Consequently, the superheat panels 1308 may not be required, thereby simplifying the design of the furnace structure 1301.

At this point it should be reiterated that vapor flow through the tubular walls of all of the above-described furnace structures provides much needed cooling to such tubular walls so as to prevent overheating and subsequent damage to the tubular walls. However, in some instances, vapor flow may still not provide adequate protection from the high temperature combustion gases which are generated for superheating duty. To provide further protection against damage and failure of the tubular walls, it may be useful to construct the tubular walls of special materials such as, for example, INCONEL 800 or an equivalent material. Such materials can withstand the high temperature combustion gases that are generated for superheating duty, particularly in the areas adjacent to a heat source whether it be a direct-fired burner, a fluidized bed, waste heat, or another heat source type. It should be noted that such materials can be beneficially coated so as to avoid adverse effects such as, for example, fire-side corrosion on the outside of the fluid tubes.

The present invention is not to be limited in scope by the specific embodiments described herein. Indeed, various modifications of the present invention, in addition to those described herein, will be apparent to those of skill in the art from the foregoing description and accompanying drawings. Thus, such modifications are intended to fall within the scope of the appended claims.

What is claimed is:

1. A method for removing process heat from a furnace, the process heat being provided within a single heat zone, the method comprising the steps of:

providing a first multi-component working fluid to a first tubular wall disposed proximate to the single heat zone to absorb a first portion of the process heat;

providing a second multi-component working fluid to a second tubular wall disposed distal to the single heat zone to absorb a second portion of the process heat.

2. The method as defined in claim 1, wherein the single heat zone is a combustion zone.

3. The method as defined in claim 2, further comprising the step of:

combusting a fossil fuel in the combustion zone.

4. The method as defined in claim 3, wherein the fossil fuel is a liquid fossil fuel.

5. The method as defined in claim 3, wherein the fossil fuel is a solid fossil fuel.

6. The method as defined in claim 1, wherein the first multi-component working fluid has a first boiling point and the second multi-component working fluid has a second boiling point.

7. The method as defined in claim 6, wherein the first boiling point is higher than the second boiling point.

8. The method as defined in claim 1, wherein the first multi-component working fluid includes ammonia and water.

9. The method as defined in claim 1, wherein the second multi-component working fluid includes ammonia and water.

10. The method as defined in claim 1, wherein the first portion of the process heat vaporizes the first multi-component working fluid.

11. The method as defined in claim 1, wherein the second portion of the process heat superheats the second multi-component working fluid.

12. The method as defined in claim 1, further comprising the step of:

transferring at least a portion of the first portion of the process heat from the first multi-component working fluid to the second multi-component working fluid.

13. The method as defined in claim 1, wherein the step of providing the first multi-component working fluid to the first tubular wall includes pumping the first multi-component working fluid to the first tubular wall.

14. A system for removing process heat from a furnace, the process heat being provided within a single heat zone, the system comprising:

at least one first fluid tube for providing a first multi-component working fluid to a first tubular wall disposed proximate to the single heat zone to absorb a first portion of the process heat;

at least one second fluid tube for providing a second multi-component working fluid to a second tubular wall disposed distal to the single heat zone to absorb a second portion of the process heat.

15. The system as defined in claim 14, wherein the single heat zone is a combustion zone.

16. The system as defined in claim 15, further comprising:

a burner for combusting a fossil fuel in the combustion zone.

17. The system as defined in claim 16, wherein the fossil fuel is a liquid fossil fuel.

18. The system as defined in claim 16, wherein the fossil fuel is a solid fossil fuel.

19. The system as defined in claim 16, wherein the first multi-component working fluid has a first boiling point and the second multi-component working fluid has a second boiling point.

20. The system as defined in claim 19, wherein the first boiling point is higher than the second boiling point.

21. The system as defined in claim 14, wherein the first multi-component working fluid includes ammonia and water.

22. The system as defined in claim 14, wherein the second multi-component working fluid includes ammonia and water.

23. The system as defined in claim 14, wherein the first portion of the process heat vaporizes the first multi-component working fluid.

24. The system as defined in claim 14, wherein the second portion of the process heat superheats the second multi-component working fluid.

25. The system as defined in claim 14, further comprising:

a heat exchanger for transferring at least a portion of the first portion of the process heat from the first multi-component working fluid to the second multi-component working fluid.

26. The system as defined in claim 14, further comprising:

a pump for forcing the first multi-component working fluid to the first tubular wall.

* * * * *